US010174641B2

(12) United States Patent
Park et al.

(10) Patent No.: US 10,174,641 B2
(45) Date of Patent: Jan. 8, 2019

(54) RANKINE CYCLE SYSTEM FOR VEHICLE HAVING DUAL FLUID CIRCULATION CIRCUIT AND METHOD OF CONTROLLING THE SAME

(71) Applicants: HYUNDAI MOTOR COMPANY, Seoul (KR); INDUSTRY-UNIVERSITY COOPERATION FOUNDATION HANYANG UNIVERSITY ERICA CAMPUS, Ansan-si, Gyeonggi-do (KR)

(72) Inventors: Dong-Won Park, Yongin-si (KR); Kyung-Wook Choi, Ansan-si (KR); Ki-Hyung Lee, Ansan-si (KR)

(73) Assignees: HYUNDAI MOTOR COMPANY, Seoul (KR); INDUSTRY-UNIVERSITY COOPERATION FOUNDATION HANYANG UNIVERSITY ERICA CAMPUS, Ansan-si, Gyeonggi-Do (KR)

( * ) Notice: Subject to any disclaimer, the term of this patent is extended or adjusted under 35 U.S.C. 154(b) by 485 days.

(21) Appl. No.: 14/856,460

(22) Filed: Sep. 16, 2015

(65) Prior Publication Data

US 2016/0102582 A1 Apr. 14, 2016

(30) Foreign Application Priority Data

Oct. 10, 2014 (KR) ..... 10-2014-0136506

(51) Int. Cl.
*F01K 13/02* (2006.01)
*F01K 27/02* (2006.01)

(52) U.S. Cl.
CPC ..... *F01K 27/02* (2013.01); *F01K 13/02* (2013.01)

(58) Field of Classification Search
CPC ..... F01K 13/02; F01K 27/02
See application file for complete search history.

(56) References Cited

U.S. PATENT DOCUMENTS 4,220,197 A 9/1980 Schaefer et al.
2004/0216483 A1* 11/2004 Inaba ..... F02G 5/04 62/498

(Continued)

FOREIGN PATENT DOCUMENTS

CN 201963362 U * 9/2011
JP 2012-002118 A 1/2012

(Continued)

OTHER PUBLICATIONS

D. Park, et al., "Development of a Simulation Model of the Steam Powered Co-generation System for Passenger Vehicle," The Korean Society of Automotive Engineers, May 2011, pp. 158-163 (Partial English translation).

*Primary Examiner* — Phutthiwat Wongwian
*Assistant Examiner* — Matthew T Largi
(74) *Attorney, Agent, or Firm* — McDermott Will & Emery LLP

(57) ABSTRACT

A Rankine cycle system for a vehicle having a dual fluid circulation circuit includes a high temperature (HT) loop in which a HT working fluid is converted to steam by heat of exhaust gas discharged from an engine. The steam is condensed back into the liquid state of the HT working fluid. A Low Temperature (LT) loop in which a temperature of an LT working fluid converted to steam is increased so that power is generated while the LT working fluid cools the HT working fluid in the HT loop, and the steam is condensed back into the liquid state of the LT working fluid. An engine coolant circulation auxiliary line forming a circulation flow in which engine coolant heats the LT working fluid and is (Continued)

then returned to the engine after the engine coolant circulated in the engine is supplied to the LT loop.

9 Claims, 23 Drawing Sheets

(56) References Cited

U.S. PATENT DOCUMENTS

| | | | | |
|---|---|---|---|---|
| 2009/0320477 | A1* | 12/2009 | Juchymenko | F01K 23/065 60/651 |
| 2013/0104547 | A1* | 5/2013 | Leduc | A45C 9/00 60/645 |

FOREIGN PATENT DOCUMENTS

| | | | |
|---|---|---|---|
| KR | 10-2006-0105498 | A | 10/2006 |
| KR | 10-1313593 | B1 | 10/2013 |
| KR | 10-2014-0055074 | A | 5/2014 |
| KR | 10-1391321 | B1 | 5/2014 |
| KR | 10-2014-0097906 | A | 8/2014 |

* cited by examiner

FIG.10B

PID Control Logic $$Err_s = T_{target_s} - T_s$$

$$u_s = K_{ps} * Err_s + K_{is} * \int_{-10sec}^{0} Err_s + K_{is} * \frac{\triangle Err_s}{\triangle T}$$

$$Err_b = T_{target_b} - T_b$$

$$u_b = K_{pb} * Err_b + K_{ib} * \int_{-10sec}^{0} Err_b + K_{db} * \frac{\triangle Err_b}{\triangle T}$$

$$u_{sum} = u_s + u_b$$

$$RPM_{pump} = RPM_n + (1 - u_{sum})$$

| | |
|---|---|
| $T_{target_s}$ | Target temperature |
| $T_s$ | Temperature after SuperHeater |
| $K_{ps}$ | P gain for SuperHeater |
| $K_{is}$ | I gain for SuperHeater |
| $K_{ds}$ | D gain for SuperHeater |
| $T_{target_b}$ | Boiling point at current pressure |
| $T_b$ | Temperature after boiler |
| $K_p$ | P gain for boiler |
| $K_i$ | I gain for boiler |
| $K_d$ | D gain for boiler |
| $RPM_{pump}$ | HT Pump control RPM |
| $RPM_n$ | Nominal Pump RPM |

<VARIABLE DEFINITION>

RANKINE CYCLE SYSTEM FOR VEHICLE HAVING DUAL FLUID CIRCULATION CIRCUIT AND METHOD OF CONTROLLING THE SAME

CROSS-REFERENCE TO RELATED APPLICATIONS

This application claims priority to Korean Patent Application No. 10-2014-0136506, filed on Oct. 10, 2014, which is incorporated herein by reference in its entirety.

TECHNICAL FIELD

Exemplary embodiments of the present invention relate to a Rankine cycle system for a vehicle; and, particularly, to a Rankine cycle system for a vehicle having a dual fluid circulation circuit separated by a high temperature pump and a low temperature pump, and a method of controlling the same.

BACKGROUND

In general, a waste heat recovery system applied to a vehicle commonly refers to a technique in which energy is recovered from exhaust gas discharged out of an engine. For example, such a technique may include a technique of generating power by immediately converting the flow of exhaust gas into rotational energy using a turbo generator, a technique of generating electric energy using a thermoelectric device, and a Rankine cycle technique of generating steam using heat of exhaust gas to rotate a turbine using the same.

The Rankine cycle technique among them has advantages of recovering energy from exhaust gas discarded as a working fluid and particularly utilizing engine coolant of a vehicle using water as a working fluid.

SUMMARY

An embodiment of the present invention is directed to a Rankine cycle system for a vehicle having a dual fluid circulation circuit in which a high temperature (HT) loop in which a HT working fluid is converted to steam by heat of exhaust gas discharged from an engine so that power is generated. The steam is condensed back into the liquid state of the HT working fluid. A Low Temperature (LT) loop in which a temperature of an LT working fluid converted to steam is increased so that power is generated while the LT working fluid cools the HT working fluid in the HT loop, and the steam is condensed back into the liquid state of the HT working fluid. An engine coolant circulation auxiliary line forming a circulation flow in which engine coolant heats the LT working fluid and is then returned to the engine after the engine coolant circulated in the engine is supplied to the LT loop. In certain embodiments, the HT loop may include a high temperature fluid supply line connected to a main exhaust line through which the exhaust gas flows so that the high temperature working fluid is changed from liquid to the steam in the high temperature fluid supply line. A high temperature expander for generating rotation power using the steam discharged from the high temperature fluid supply line may also be included. The HT loop may also include a high temperature fluid return line in which the steam passing through the high temperature expander is changed into liquid to be supplied to the high temperature fluid supply line.

In certain embodiments, the LT loop may include a low temperature fluid supply line connected to the engine coolant circulation auxiliary line through which the engine coolant flows so that the low temperature working fluid is converted from liquid to the steam in the low temperature fluid supply line. The LT loop may also include a low temperature expander for generating rotation power using the steam discharged from the low temperature fluid supply line. A low temperature fluid return line in which the steam passing through the low temperature expander is converted into the liquid to be supplied to the low temperature fluid supply line may also be included.

In certain embodiments, the engine coolant circulation auxiliary line may include an engine coolant withdrawal line through which the engine coolant is discharged from the engine and an engine coolant direct return line through which the engine coolant is directly returned to the engine. The engine coolant circulation auxiliary line may also include an engine coolant indirect return line branched off from the engine coolant direct return line so as to form a path through which the engine coolant in the engine coolant withdrawal line is returned to the engine via an engine radiator.

In certain embodiments, the HT loop may further include a high temperature boiler and a high temperature superheater which are installed on the high temperature fluid supply line and a high temperature condenser, a high temperature pump, a high temperature electronic expansion valve, and a high temperature fluid reservoir which are installed on the high temperature fluid return line.

In certain embodiments, the LT loop may further include a low temperature boiler and a low temperature superheater which are installed on the low temperature fluid supply line, and a low temperature recuperator, a low temperature condenser, a low temperature pump, a low temperature electronic expansion valve, and a low temperature fluid reservoir which are installed on the low temperature fluid return line. The high temperature condenser may be connected to the low temperature fluid supply line and the low temperature superheater may be connected to the low temperature fluid supply line. The high temperature condenser which shares the body with the low temperature superheater transfers heat from the high temperature loop to the low temperature loop while cooling the HT fluid with LT fluid.

In certain embodiments, the Rankine cycle system may further include a catalytic converter installed on the main exhaust line and a silencer installed on the main exhaust line. A branch exhaust line may branch off from a first section of the main exhaust line. The branch exhaust line may connect the catalytic converter to the silencer. An exhaust bypass valve may be installed on the branch exhaust line. The high temperature boiler may be installed in the first section of the main exhaust line, and the high temperature superheater may be installed in a second section of the main exhaust line. The second section may connect the engine to the catalytic converter.

In certain embodiments, the HT loop and the LT loop may be controlled in a PID manner by a Rankine controller configured to output a PWM duty (Pulse Width Modulation duty). The Rankine controller may include an error check block configured to check errors of the HT loop, the engine, or the LT loop. A high temperature pump control block may be configured to configure the HT loop so as to control a speed of a high temperature pump for circulating the high temperature working fluid, and a low temperature pump control block may be configured to configure the LT loop so as to control a speed of a low temperature pump for circulating the low temperature working fluid.

Also disclosed is a method of controlling a Rankine cycle system for a vehicle having a dual fluid circulation circuit. The method may include performing a system diagnosis on the Rankine cycle system.

In certain embodiments, the step of performing the system diagnosis, the sub-step of initializing the HT loop and the LT loop by a Rankine controller when the engine is started may be realized by variables, such as Clutch disengage, HT Bypass Valve On, LT Bypass Valve On, Exhaust Bypass Valve Off, and Radiator Bypass Valve On, which are formed in each of the HT loop and the LT loop, and the error check is realized by variables, such as HT Pump Error State Normal, LT Pump Error State Normal, and HT Bypass Valve Error State Normal, which are formed in each of the HT loop and the LT loop.

In certain embodiments, in the step of performing the system diagnosis, a sub-step of controlling the states of components of the HT loop and the LT loop is realized by variables such as HT Clutch disengage, HT Bypass Valve On, LT Bypass Valve On, Exhaust Bypass Valve On, Radiator Bypass Valve Off, HT Pump_Max, and LT Pump_Max.

Objects and advantages of the present invention can be understood by the following description, and become apparent with reference to the embodiments of the present invention. Also, it is clear to those skilled in the art to which the present invention pertains that the objects and advantages of the present invention can be realized by the means as claimed and combinations thereof.

BRIEF DESCRIPTION OF THE DRAWINGS

FIGS. 2A and 2B to FIGS. 5A, 5B and 5C are diagrams illustrating respective exemplary configurations of an error check block, an HT pump control block, and an LT pump control block in a Rankine controller according to the embodiment of the present invention.

FIGS. 6A and 6B to FIGS. 8A, 8B and 8C are flowcharts illustrating a method of controlling a Rankine cycle system for a vehicle having a dual fluid circulation circuit according to an embodiment of the present invention.

FIGS. 10A and 10B are a view illustrating an example of a high temperature pump PID reinforcement control logic in which temperatures of a high temperature boiler and a high temperature superheater are used as control variables in the method of controlling a Rankine cycle system for a vehicle having a dual fluid circulation circuit according to the embodiment of the present invention.

DETAILED DESCRIPTION

Figure 1A:
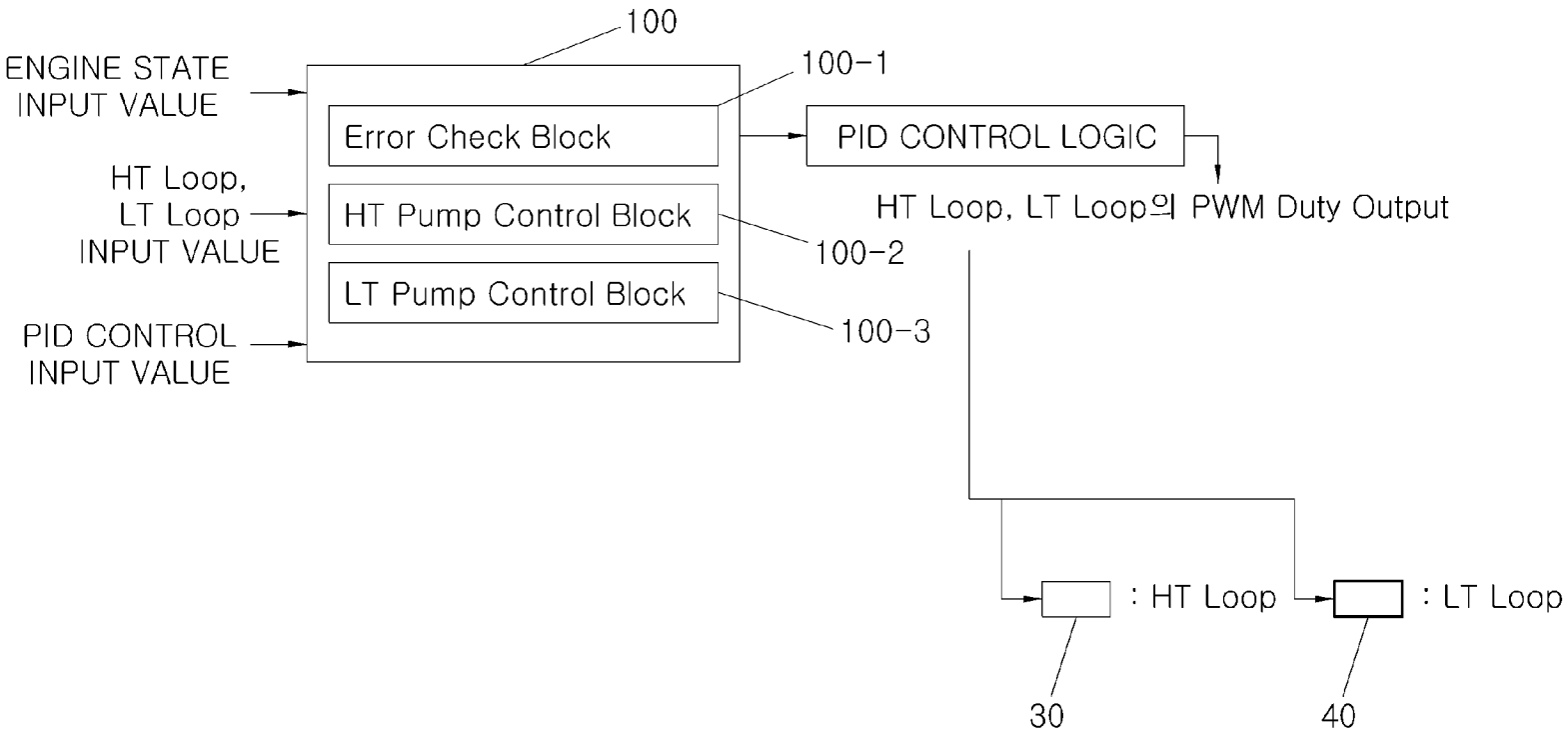
FIGS. 1A and 1B are a diagram illustrating a configuration of a Rankine cycle system for a vehicle having a dual fluid circulation circuit according to an embodiment of the present invention.

Exemplary embodiments of the present invention will be described below in more detail with reference to the accompanying drawings. The present invention may, however, be embodied in different forms and should not be construed as limited to the embodiments set forth herein. Throughout the disclosure, like reference numerals refer to like parts throughout the various figures and embodiments of the present invention.

Figure 1B:
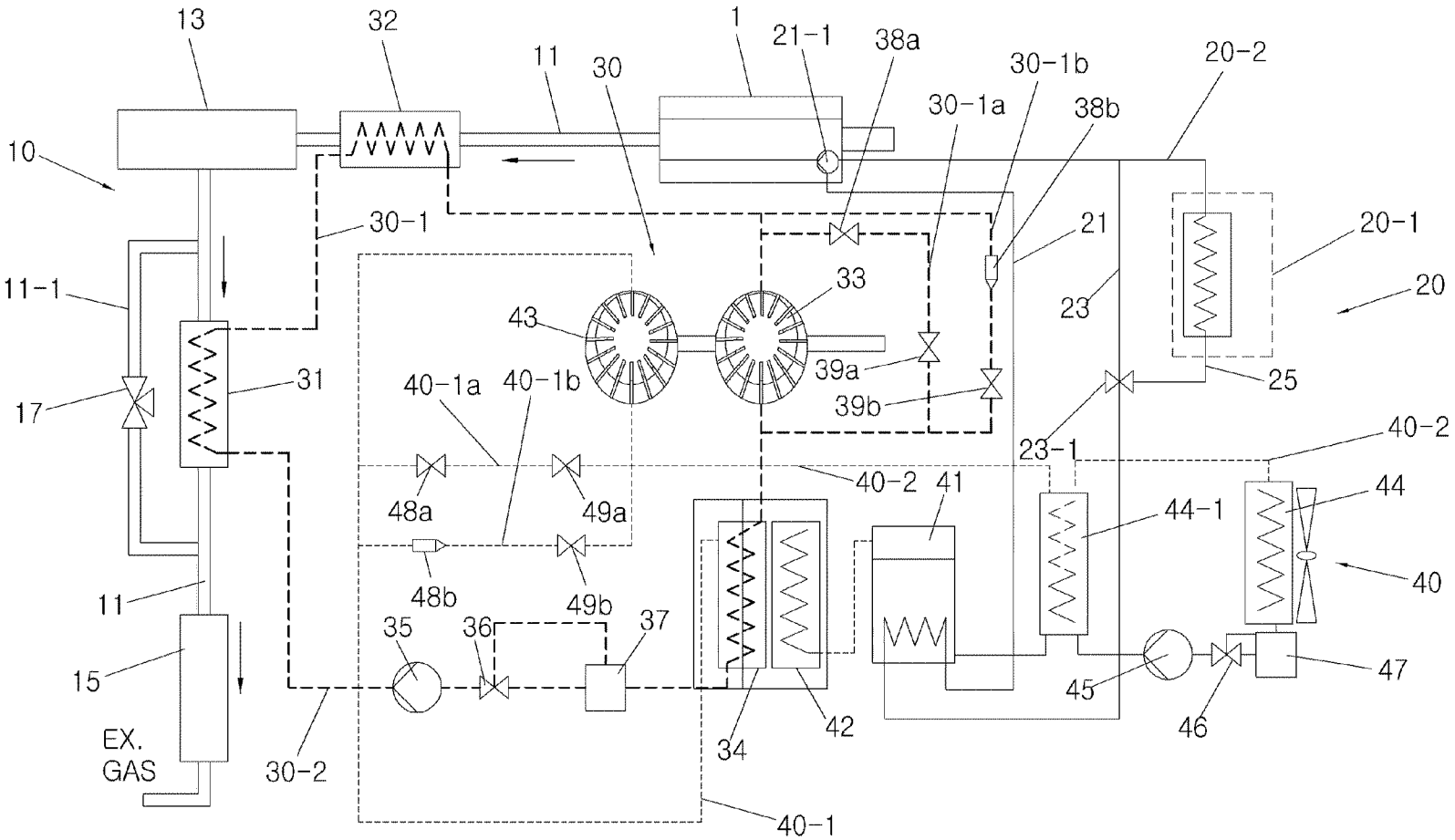
Figure 2A:
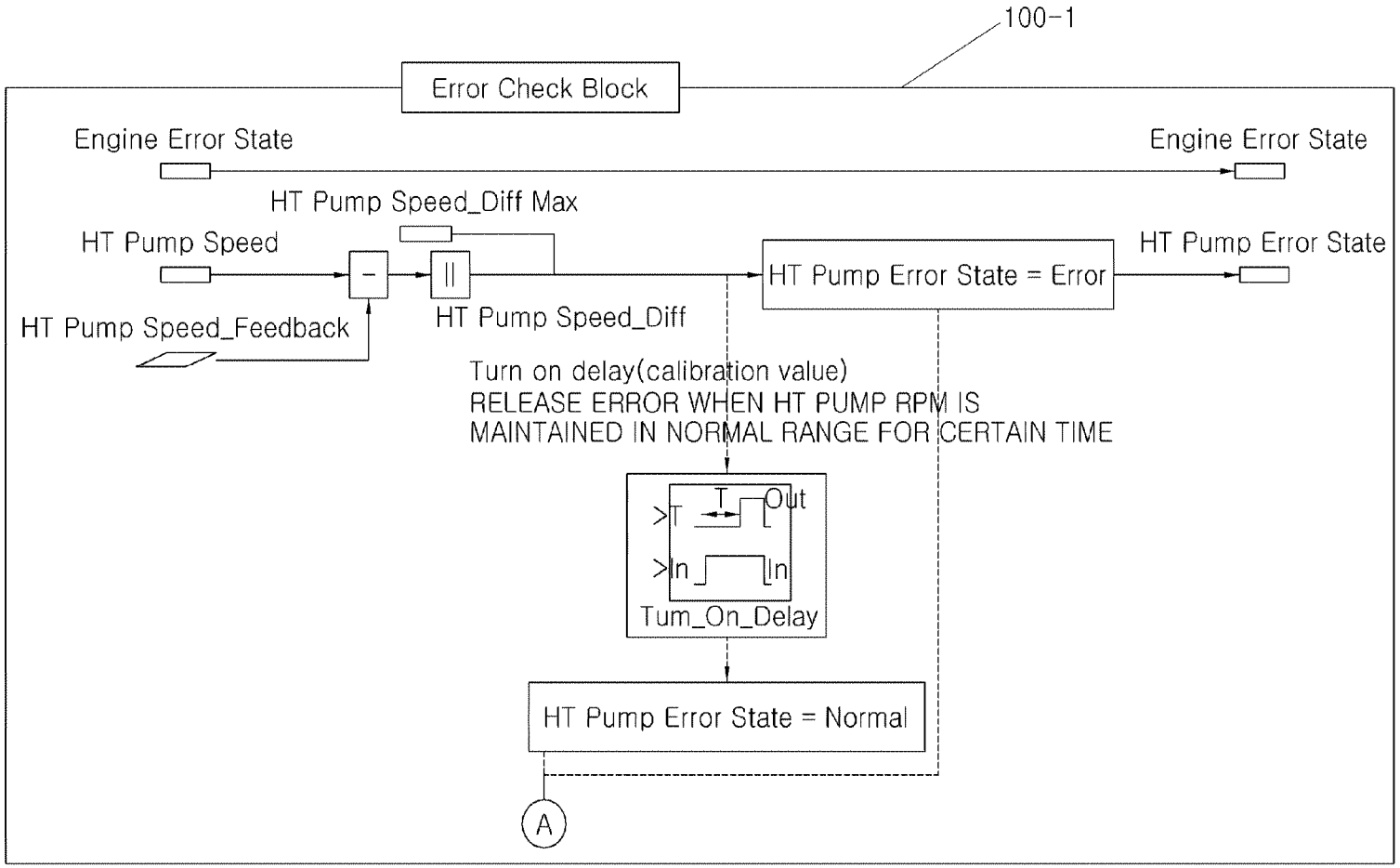
Figure 2B:
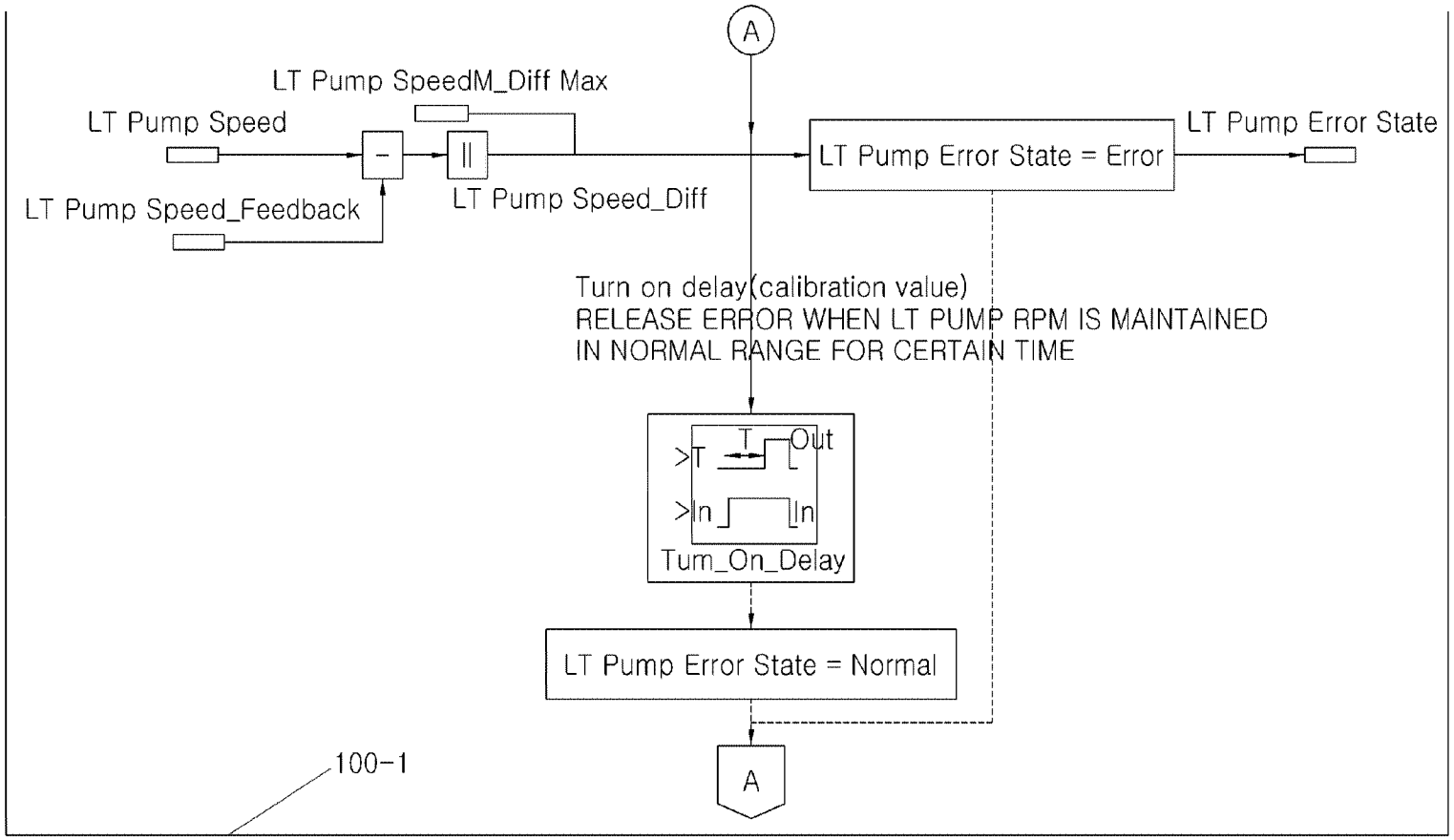
Figure 3A:
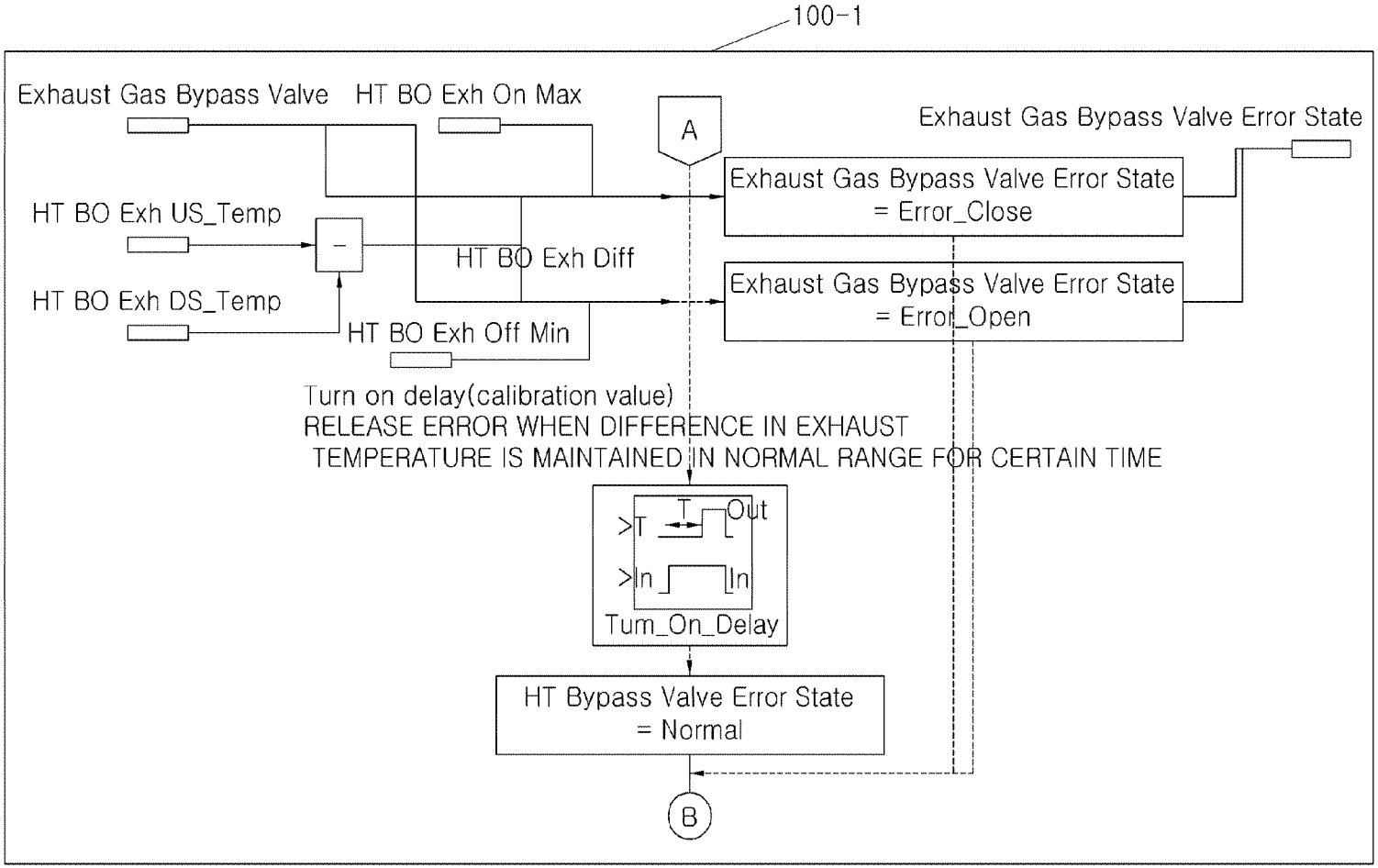
Figure 3B:
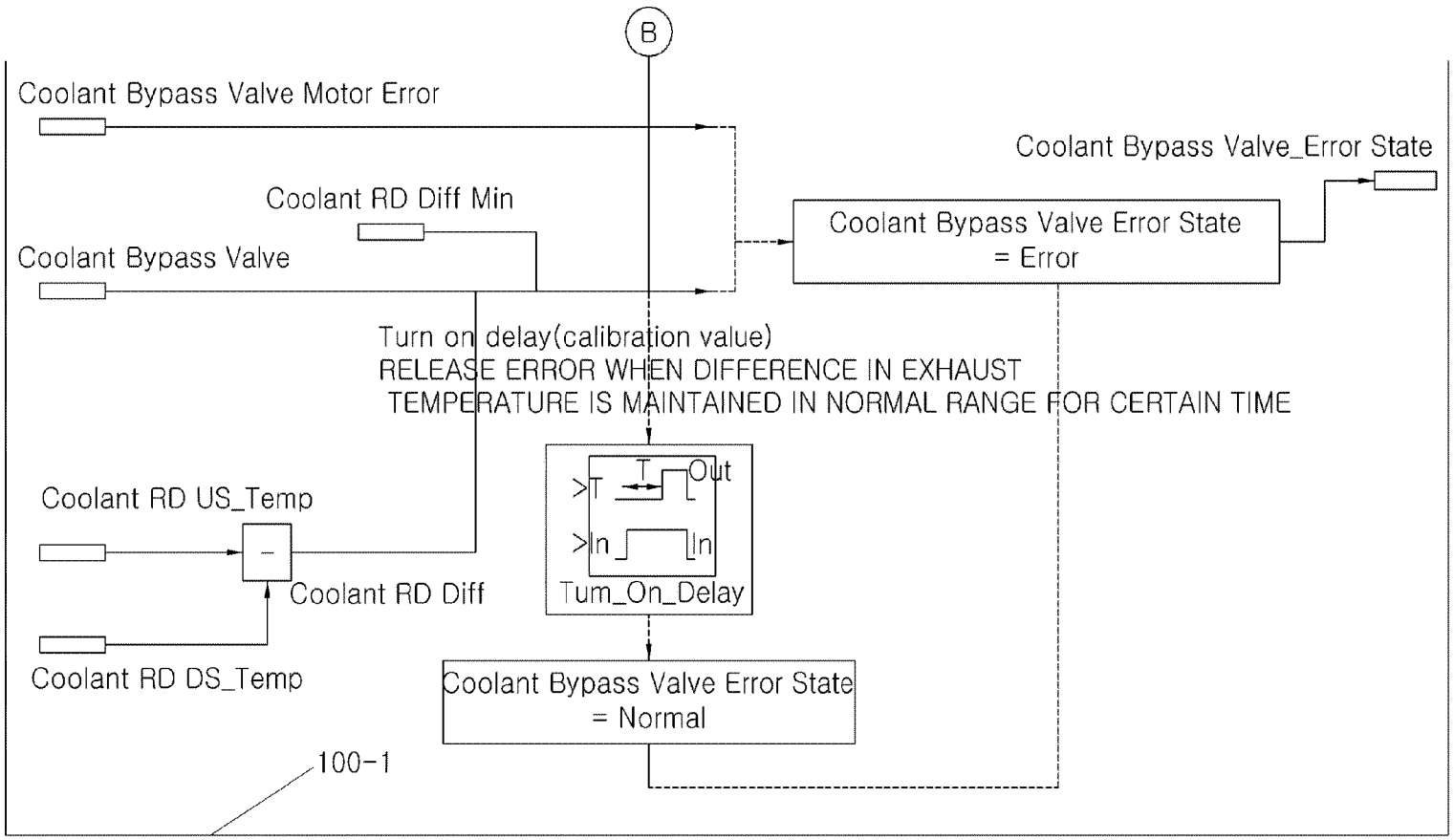

FIGS. 1A and 1B illustrate a configuration of a Rankine cycle system for a vehicle having a dual fluid circulation circuit according to an embodiment of the present invention.

As shown in the drawings, the Rankine cycle system includes an engine 1, an exhaust system 10, an engine cooling system 20, a high temperature loop (hereinafter, referred to as "HT loop") 30 using water as a high temperature working fluid, a low temperature loop (hereinafter, referred to as "LT loop") 40 using water as a low temperature working fluid, and, in certain embodiments, a Rankine controller 100 for performing a PID control logic.

The engine 1 is an internal combustion engine to generate power by combustion of fuel, and is controlled by an ECU (Engine Control Unit or Electronic Control Unit). In certain embodiments, the ECU includes the Rankine controller 100.

In certain embodiments, the exhaust system 10 includes a main exhaust line 11 through which exhaust gas discharged from the engine 1 flows, a catalytic converter 13 installed on the main exhaust line 11 to remove harmful substances in the exhaust gas, a silencer 15 for reducing noise of the exhaust gas discharged from the catalytic converter 13 to discharge the exhaust gas to the atmosphere, a branch exhaust line 11-1 branched from the main exhaust line 11 to connect the catalytic converter 13 to the silencer 15, and an exhaust bypass valve 17 installed on the branch exhaust line 11-1. The bypass valve 17 is controlled by the Rankine controller 100, and the Rankine controller 100 is included in the ECU.

In certain embodiments, the engine cooling system 20 is similar to a typical water-cooled engine cooling system in that it has an engine radiator 20-1 in which engine coolant is circulated. However, the engine cooling system 20 differs from the typical water-cooled engine cooling system in terms of further including an engine coolant circulation auxiliary line 20-2 through which high temperature engine coolant is supplied to the LT loop 40 so as to heat the low temperature working fluid in the LT loop 40.

In certain embodiments, the engine coolant circulation auxiliary line 20-2 includes an engine coolant withdrawal line 21 connected to an engine coolant pump 21-1 so that the engine coolant of the engine 1 is discharged through the engine coolant withdrawal line 21, an engine coolant direct return line 23 through which the engine coolant is directly returned to the engine 1, an engine coolant indirect return line 25 branched from the engine coolant direct return line 23 to the engine radiator 20-1 such that the engine coolant is indirectly returned to the engine 1 via the engine radiator 20-1, and a radiator bypass valve 23-1 installed between the engine coolant direct return line 23 and the engine coolant indirect return line 25. The engine coolant pump 21-1 and the radiator bypass valve 23-1 are controlled by the Rankine controller 100, and the Rankine controller 100 is included in the ECU.

In certain embodiments, the HT loop 30 includes a high temperature fluid supply line 30-1 through which the high temperature working fluid is changed from liquid to steam and flows and a high temperature fluid return line 30-2 through which the high temperature working fluid is changed from steam to liquid and flows. The high temperature fluid supply line 30-1 and the high temperature fluid return line 30-2 form a closed circuit connected to the main exhaust line 11 of the exhaust system 10, thereby allowing rotation power to be generated by conversion of the high temperature working fluid to steam by the exhaust gas. This is used to generate power by a typical generator. In certain embodiments, electricity generated by the HT loop 30 is supplied as electric power to charge a vehicle battery or to operate various electric devices in a vehicle.

To this end, the high temperature fluid supply line 30-1 and the high temperature fluid return line 30-2 are equipped with a high temperature boiler (hereinafter, referred to as "HT_BO") 31, a high temperature superheater (hereinafter, referred to as "HT_SH") 32, a high temperature expander 33, a high temperature condenser (hereinafter, referred to as "HT_Cond") 34, a high temperature pump (hereinafter, referred to as "HT pump") 35, a high temperature electronic expansion valve (hereinafter, referred to as "HT_EEV") 36, and a high temperature fluid reservoir 37.

In certain embodiments, the HT_BO 31 and the HT_SH 32 are installed on the high temperature fluid supply line 30-1. In certain embodiments, the HT_BO 31 is installed on the main exhaust line 11 extending from the catalytic converter 13 so as to change the high temperature working fluid to steam by heat of the exhaust gas discharged from the catalytic converter 13. In certain embodiments, the HT_SH 32 is installed on the main exhaust line 11 connected to the catalytic converter 13 so as to further increase a temperature of the steam discharged from the HT_BO 31 using heat of the exhaust gas discharged from the engine 1 in a state in which a pressure of the steam is maintained.

In certain embodiments, the high temperature expander 33 connects an end portion of the high temperature fluid supply line 30-1 to a start portion of the high temperature fluid return line 30-2. The high temperature expander 33 is rotated by high pressure and high temperature steam discharged from the HT_SH 32 to generate rotation power, and generates current to charge the vehicle battery or to operate the various electric devices in the vehicle by generating electricity using the rotation power.

In certain embodiments, the HT_Cond 34, the HT pump 35, the HT_EEV 36, and the high temperature fluid reservoir 37 are installed on the high temperature fluid return line 30-2. The HT_Cond 34 changes the steam discharged from the high temperature expander 33 into a liquid phase high temperature working fluid by condensing the steam. The HT pump 35 pumps the high temperature working fluid in the high temperature fluid reservoir 37 during engagement of a clutch (hereinafter, referred to as "HT clutch"), and facilitates circulation of the high temperature working fluid flowing in the high temperature fluid supply line 30-1 and the high temperature fluid return line 30-2. The HT_EEV 36 opens a path through which the high temperature working fluid is returned to the high temperature fluid reservoir 37 when the HT_EEV 36 is turned on, whereas closes the path through which the high temperature working fluid is returned to the high temperature fluid reservoir 37 when the HT_EEV 36 is turned off. The high temperature fluid reservoir 37 stores the high temperature working fluid. In particular, the HT pump 35, the HT clutch, and the HT_EEV 36 are controlled by the Rankine controller 100, and the Rankine controller 100 is included in the ECU. In addition, the HT_Cond 34 is connected to the LT loop 40 so as to decrease the temperature of the high temperature working fluid by increasing the temperature of the low temperature working fluid and facilitate that the low temperature working fluid is changed into steam. Detailed description thereof will be given when the LT loop 40 is described.

In addition, in certain embodiments, the HT loop 30 further includes a high temperature fluid bypass line **30-1*a* and a high temperature fluid safety line 30-1*b* which are each branched from the high temperature fluid supply line 30-1 to be connected to the high temperature fluid return line 30-2 such that the high temperature working fluid does not pass through the high temperature expander 33. The high temperature fluid bypass line 30-1*a* is provided with a first orifice 38*a* for branching a steam flow to reduce an allowable steam overpressure and a first bypass valve 39*a* (hereinafter, referred to as "HT bypass valve") for opening and closing a passage, thereby allowing the high temperature expander 33 to be always operated at an allowable steam pressure. In addition, the high temperature fluid safety line 30-1*b* is provided with a first safety valve 39*b* which is opened at a steam overpressure and a second orifice 38*b* for reducing the steam overpressure, thereby allowing the high temperature expander 33 to be always operated at the allowable steam pressure. In this case, the allowable steam pressure is lower than the allowable steam overpressure, and the allowable steam overpressure is lower than the steam overpressure. In addition, in certain embodiments, the bypass valve is controlled by the Rankine controller 100, and the Rankine controller 100** is included in the ECU.

The LT loop 40 includes a low temperature fluid supply line 40-1 through which the low temperature working fluid is changed from liquid to steam and flows and a low temperature fluid return line 40-2 through which the low temperature working fluid is changed from steam to liquid and flows. The low temperature fluid supply line 40-1 and the low temperature fluid return line 40-2 form a closed circuit connected to the engine cooling system 20 and the HT loop 30, thereby allowing the low temperature working fluid to be easily changed into steam and allowing rotation power to be generated by increase in temperature of the low temperature working fluid using engine coolant of the engine 1 and further heat of the high temperature working fluid. Electricity generated by the LT loop 40 is supplied as electric power to charge the vehicle battery or to operate the various electric devices in the vehicle.

To this end, the low temperature fluid supply line 40-1 and the low temperature fluid return line 40-2 are equipped with a low temperature boiler (hereinafter, referred to as "LT_BO") 41, a low temperature superheater (hereinafter, referred to as "LT_SH") 42, a low temperature expander 43, a low temperature recuperator 44-1, a low temperature condenser (hereinafter, referred to as "LT_Cond") 44, a low temperature pump (hereinafter, referred to as "LT pump") 45, a low temperature electronic expansion valve (hereinafter, referred to as "LT_EEV") 46, and a low temperature fluid reservoir 47.

The LT_BO 41 and the LT_SH 42 are installed on the low temperature fluid supply line 40-1. The low temperature fluid supply line 40-1 is connected from the LT_SH 42 to the HT_Cond 34 and is then connected from the HT_Cond 34 to the low temperature expander 43. The LT_BO 41 is connected to the engine coolant withdrawal line 21 of the engine coolant circulation auxiliary line 20-2 connected to the engine cooling system 20, thereby changing the low temperature working fluid into steam while increasing temperature thereof by heat of the engine coolant. In addition, the LT_BO 41 facilitates that the low temperature working fluid is changed into steam by further heat of the high temperature working fluid during pass of the HT_Cond 34. The LT_SH 42 is installed between the LT_BO 41 and the HT_Cond 34 so as to further increase temperatures of low coolant or steam passing through the HT_Cond 34 from the LT_BO 41 in a state in which a pressure of the low coolant or steam is maintained.

In certain embodiments, the low temperature expander 43 connects an end portion of the low temperature fluid supply line 40-1 to a start portion of the low temperature fluid return line 40-2. In certain embodiments, the low temperature expander 43 is rotated by high pressure and high temperature steam discharged from the LT_SH 42 via the HT_Cond 34 to generate rotation power, and generates current to charge the vehicle battery or to operate the various electric devices in the vehicle by generating electricity using the rotation power.

In certain embodiments, the low temperature recuperator 44-1 is installed on the low temperature fluid return line 40-2, and is connected to the low temperature fluid supply line 40-1. Therefore, the low temperature recuperator 44-1 heats the low temperature working fluid, which is pumped to the LT pump 45 and stored in the low temperature fluid reservoir 47, using the temperature of steam discharged from the low temperature expander 43, and then supplies the heated fluid to the LT_BO 41.

In certain embodiments, the LT_Cond 44, the LT pump 45, the LT_EEV 46, and the low temperature fluid reservoir 47 are installed on the low temperature fluid return line 40-2. The LT_Cond 44 changes the steam discharged from the low temperature expander 43 into a liquid phase low temperature working fluid by condensing the steam. The LT pump 45 pumps the low temperature working fluid in the low temperature fluid reservoir 47 during engagement of a clutch (hereinafter, referred to as "LT clutch"), and facilitates circulation of the low temperature working fluid flowing in the low temperature fluid supply line 40-1 and the low temperature fluid return line 40-2. The LT_EEV 46 opens a path through which the low temperature working fluid is returned to the low temperature fluid reservoir 47 when the LT_EEV 46 is turned on, whereas closes the path through which the low temperature working fluid is returned to the low temperature fluid reservoir 47 when the LT_EEV 46 is turned off. The low temperature fluid reservoir 47 stores the low temperature working fluid. In particular, in certain embodiments, the LT pump 45, the LT clutch, and the LT_EEV 46 are controlled by the Rankine controller 100, and the Rankine controller 100 is included in the ECU.

In addition, in certain embodiments, the low temperature fluid supply line 40-1 further includes a low temperature fluid bypass line 40-1*a* and a low temperature fluid safety line 40-1*b* which are each branched from the low temperature fluid supply line 40-1 to be connected to the low temperature fluid return line 40-2 such that the low temperature working fluid does not pass through the low temperature expander 43. The low temperature fluid bypass line 40-1*a* is provided with a third orifice 48*a* for branching a steam flow to reduce an allowable steam overpressure and a second bypass valve 49*a* (hereinafter, referred to as "LT bypass valve") for opening and closing a passage, thereby allowing the low temperature expander 43 to be always operated at an allowable steam pressure. In addition, the low temperature fluid safety line 40-1*b* is provided with a second safety valve 49*b* which is opened at a steam overpressure and a fourth orifice 48*b* for reducing the steam overpressure, thereby allowing the low temperature expander 43 to be always operated at the allowable steam pressure. In this case, the allowable steam pressure is lower than the allowable steam overpressure, and the allowable steam overpressure is lower than the steam overpressure. In addition, the bypass valve is controlled by the Rankine controller 100, and the Rankine controller 100 is included in the ECU.

Figure 10A:
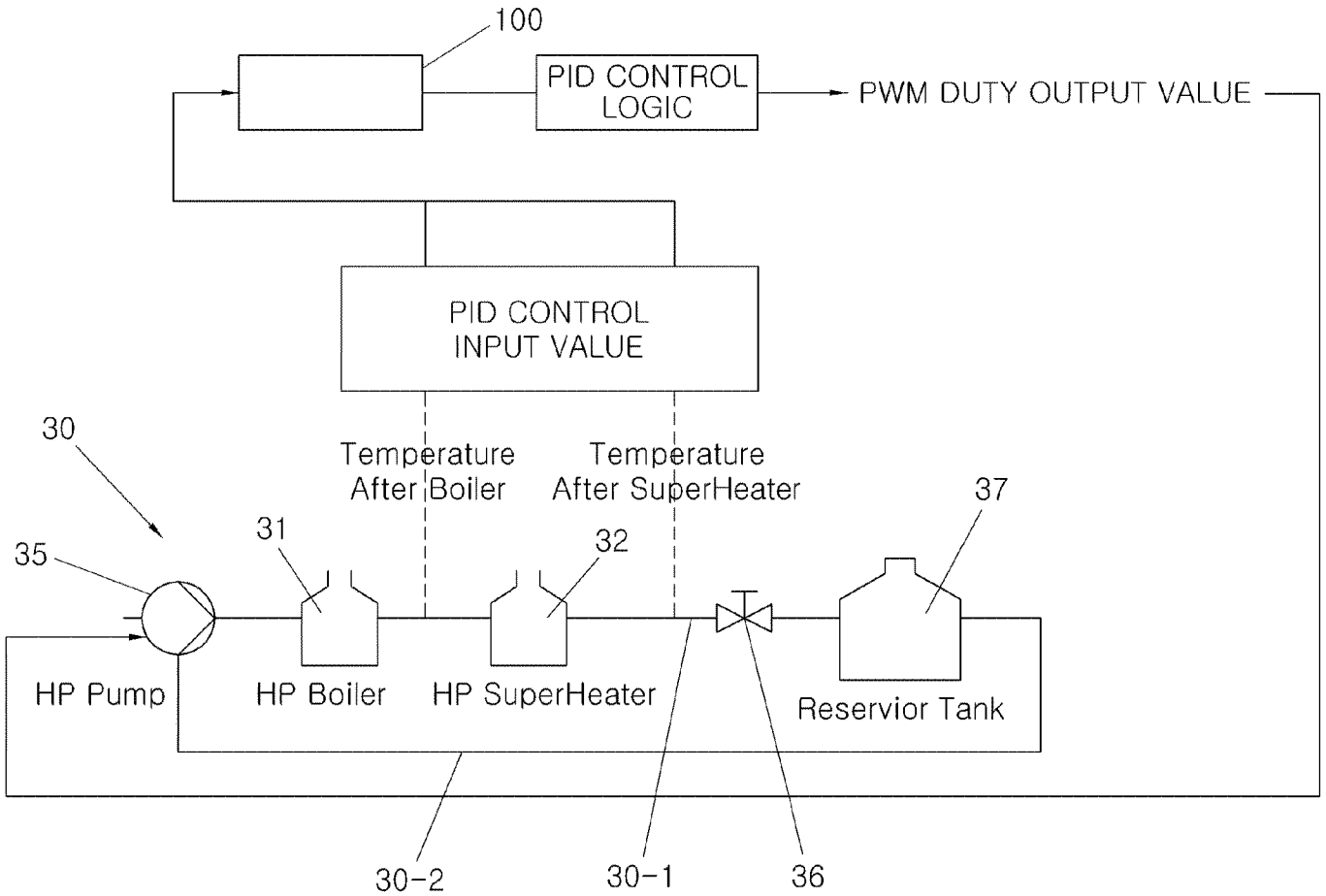

The Rankine controller 100 checks a system error of each component of the HT loop 30 and the LT loop 40 and controls engine coolant circulation such that the low temperature working fluid is not frozen under a freezing condition. To this end, the Rankine controller 100 includes an error check block 100-1, an HT pump control block 100-2, and an LT pump control block 100-3. In addition, the Rankine controller 100 performs a PID control logic using PID control input values which set temperatures of the HT_SH 32 of the HT loop 30 and the LT_SH 42 of the LT loop 40 as control variables. FIGS. 10A and 10B illustrate an example of the PID control logic.

Meanwhile, FIGS. 2A and 2B to FIGS. 5A, 5B and 5C illustrate respective exemplary configurations of the error check block 100-1, the HT pump control block 100-2, and the LT pump control block 100-3 of the Rankine controller 100.

Referring to FIGS. 2A and 2B and FIGS. 3A and 3B, the error check block 100-1 is configured such that variables, such as Engine Error State for processing an engine error state, HT Pump Speed, HT Pump Speed_Feedback, HT Pump Speed_Diff Max, and HT Pump Speed_Diff for processing an HT pump error state, LT Pump Speed, LT Pump Speed_Feedback, LT Pump SpeedM_Diff Max, and LT Pump Speed_Diff for processing an LT pump error state, Exhaust Gas Bypass Valve, HT BO Exh On Max, HT BO Exh US_Temp, HT BO Exh DS_Temp, HT BO Exh Diff, and HT BO Exh Off Min for processing an exhaust gas bypass valve error state, and a radiator bypass valve Motor Error, radiator bypass valve, Coolant RD Diff Min, Coolant RD US_Temp, Coolant RD DS_Temp, and Coolant RD Diff for processing a radiator bypass valve_error state, are linked to each other.

Figure 4A:
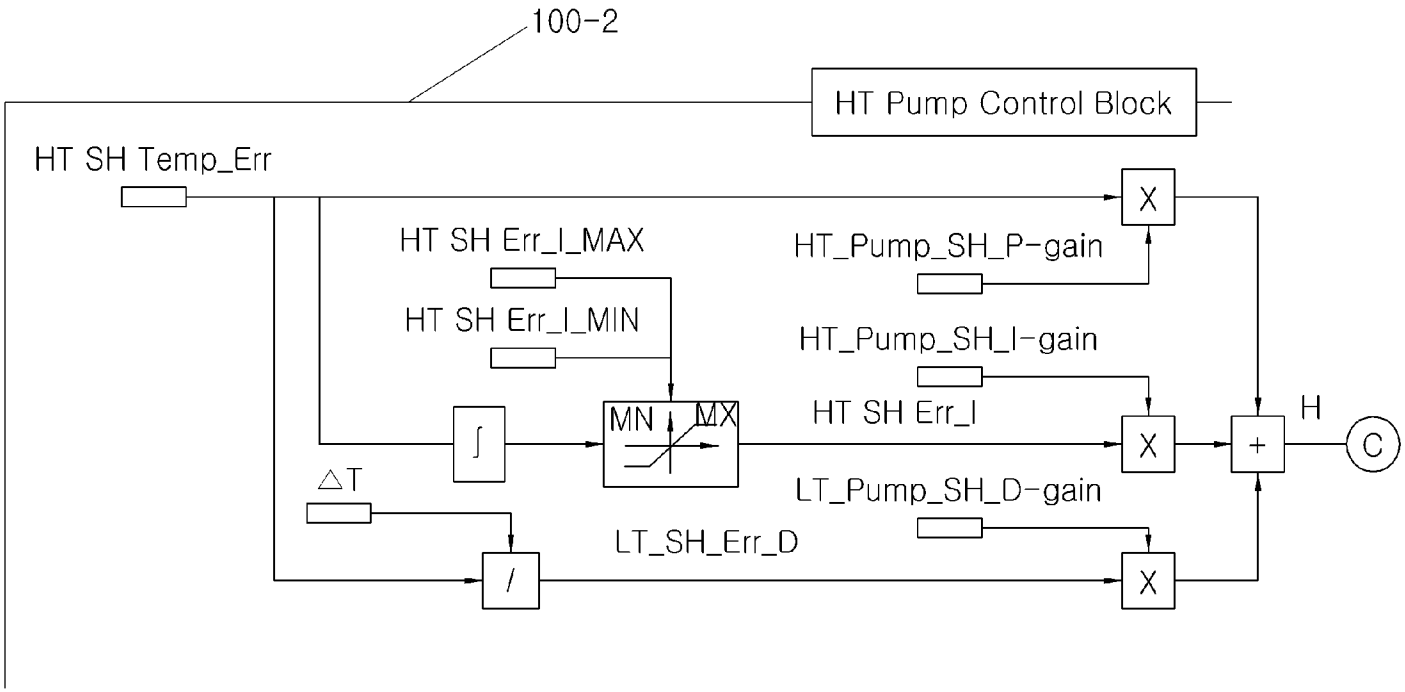
Figure 4B:
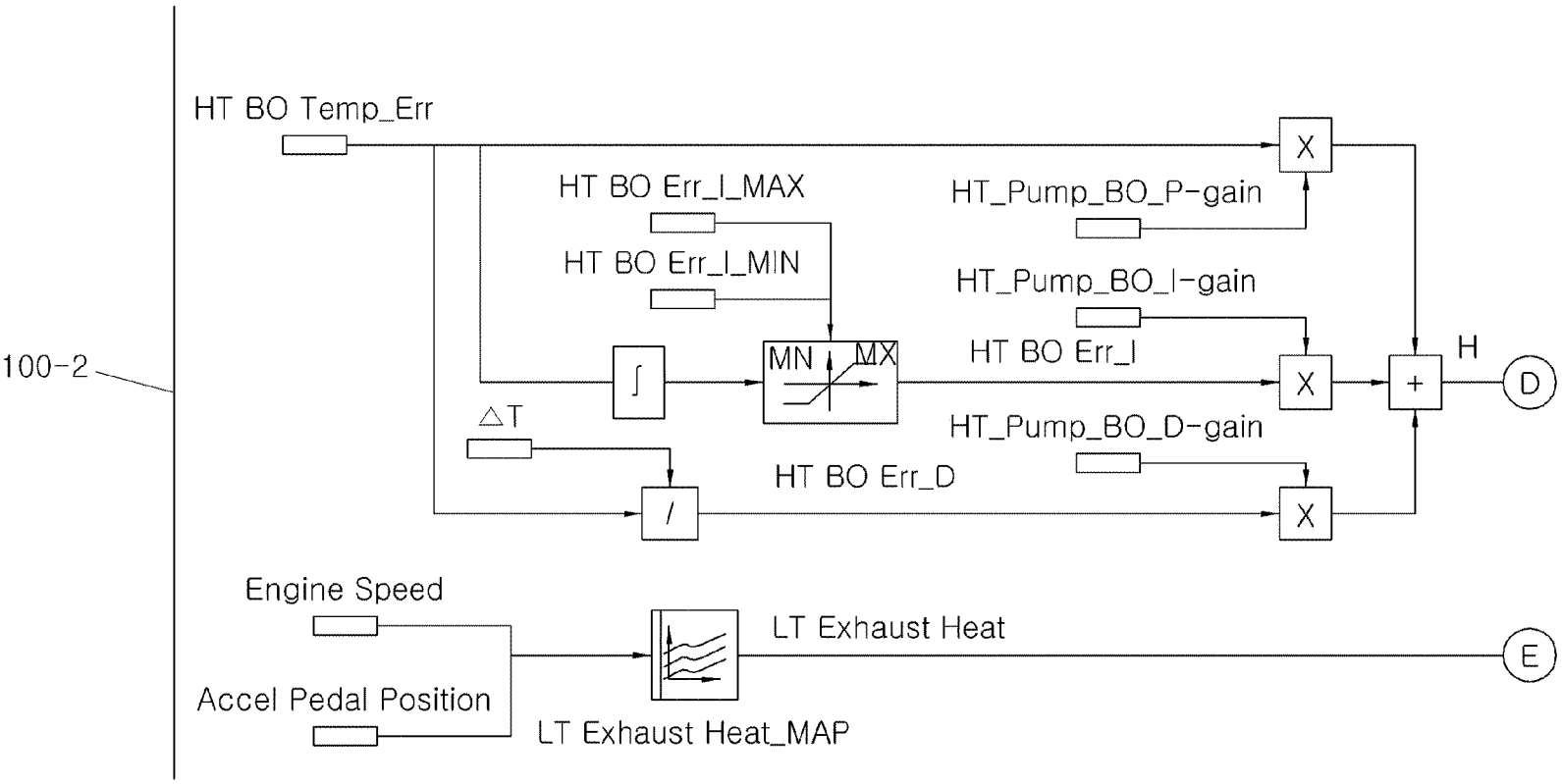
Figure 4C:
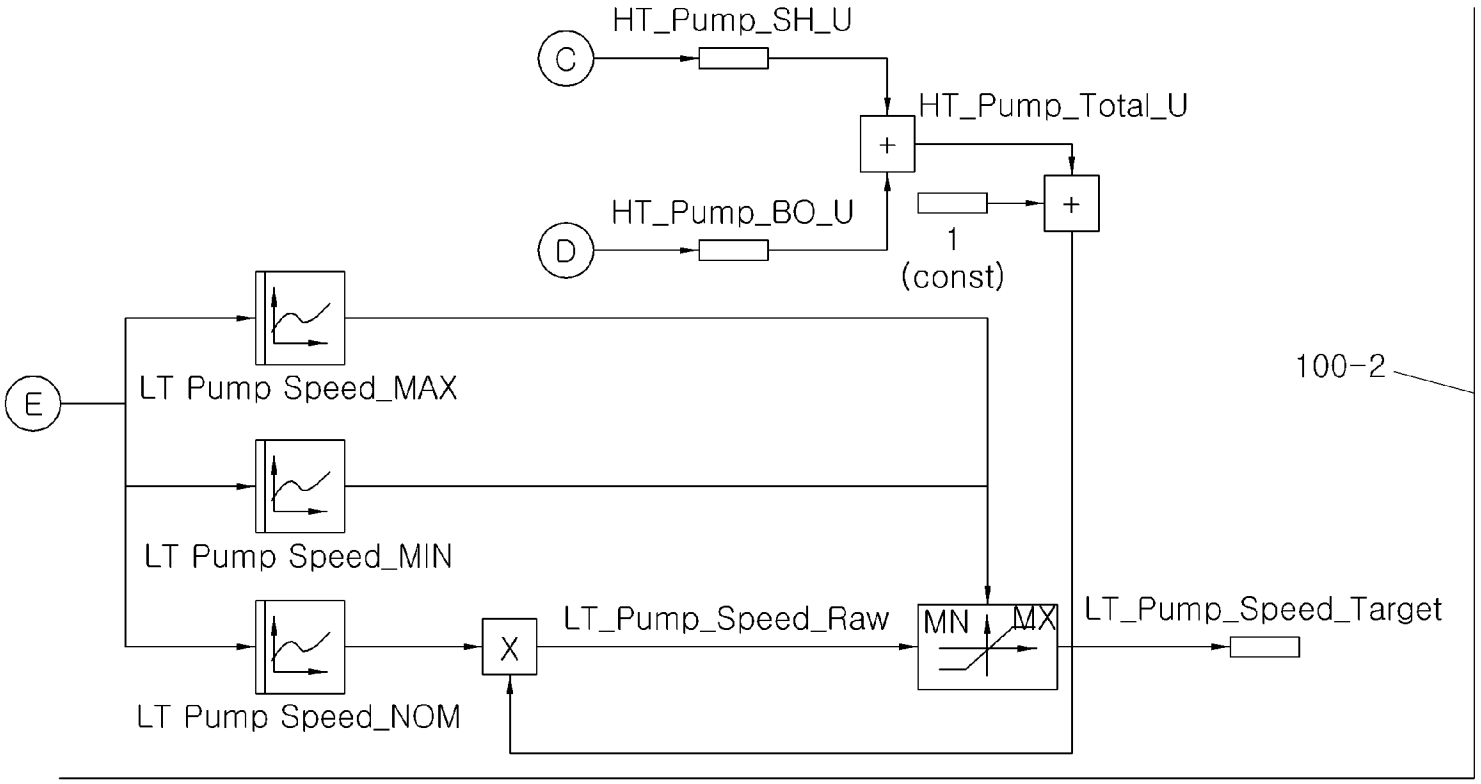

Referring to FIGS. 4A, 4B and 4C, the HT pump control block 100-2 is configured such that variables, such as HT SH Temp_Err, HT SH Err_I_MAX, HT SH Err_I_MIN, HT_Pump_SH_P-gain, HT_Pump_SH_I-gain, HT SH Err_I, T, HT SH Err_D, HT_Pump_SH_D-gain, HT_Pump_SH_U, HT BO Temp_Err, HT BO Err_I_MAX, HT BO Err_I_MIN, HT_Pump_BO_P-gain, HT_Pump_BO_I-gain, HT BO Err_I, HT_Pump_BO_D-gain, T, HT BO Err_D, HT_Pump_BO_U, HT_Pump_Total_U, Engine Speed, Accel Pedal Position, HT Exhaust Heat, HT Pump Speed_MAX, HT Pump Speed_MIN, HT Pump Speed_NOM, and HT_Pump_Speed_Raw for processing an HT_pump_speed_target, are linked to each other.

Figure 5A:
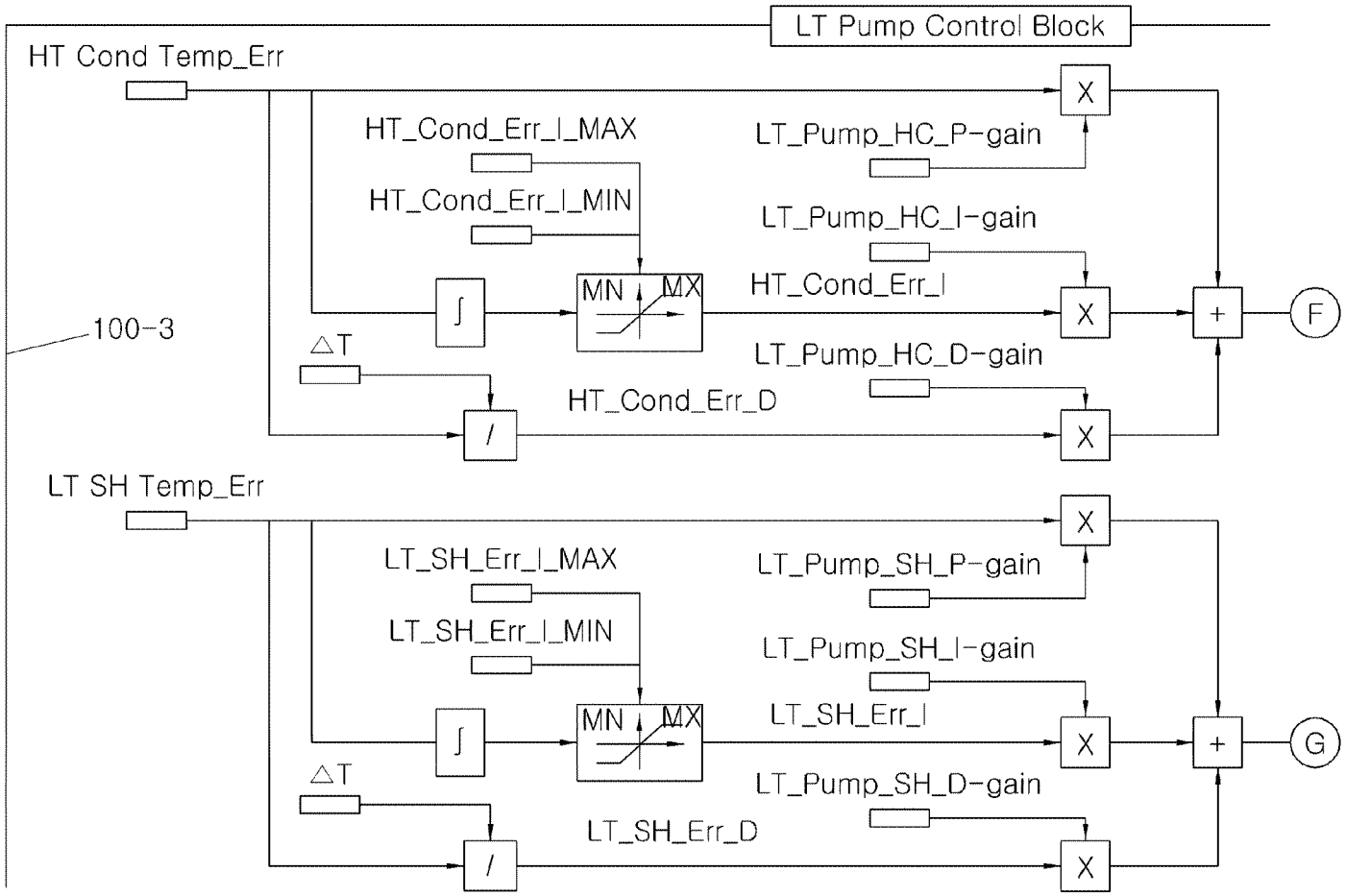
Figure 5B:
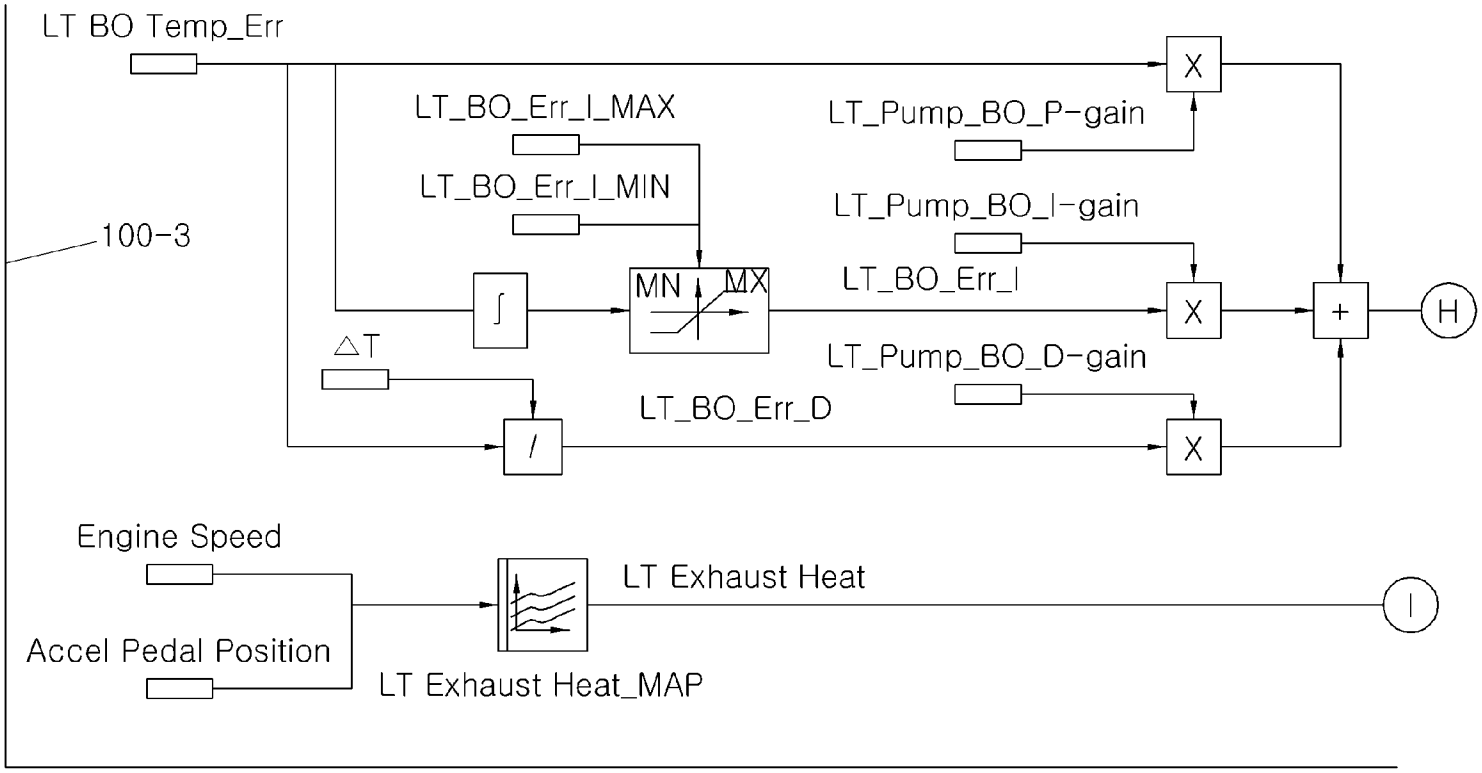
Figure 5C:
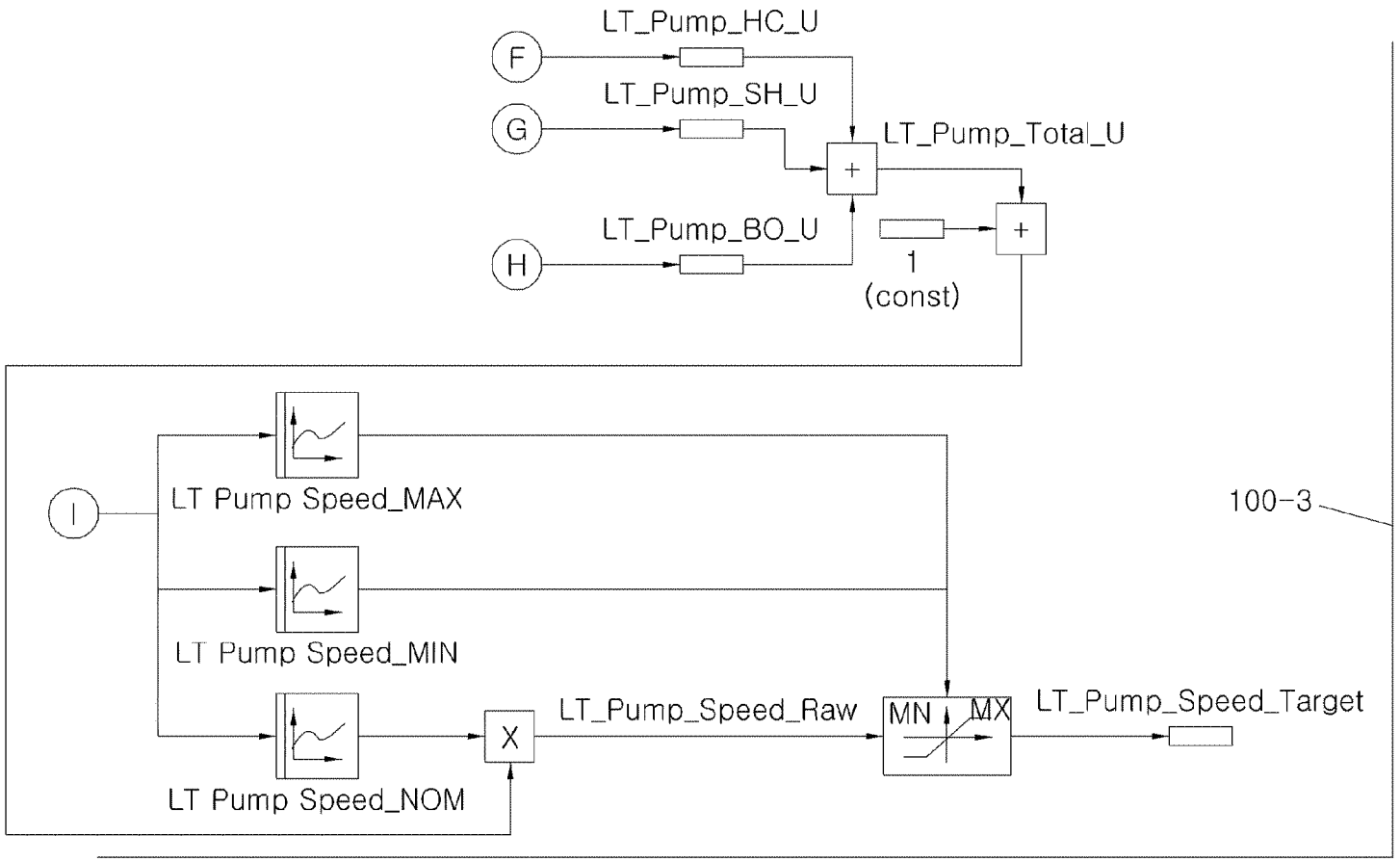

Referring to FIGS. 5A, 5B and 5C, the LT pump control block 100-3 is configured such that variables, such as HT Cond Temp_Err, HT_Cond_Err_I_MAX, HT_Cond_Err_I_MIN, LT_Pump_HC_P-gain, LT_Pump_HC_I-gain, HT_Cond_Err_I, T, HT_Cond_Err_D, LT_Pump_HC_D-gain, LT_Pump_HC_U, LT SH Temp_Err, LT_SH_Err_I_MAX, LT_SH_Err_I_MIN, LT_Pump_SH_P-gain, LT_Pump_SH_I-gai, LT_SH_Err_I, T, LT_SH_Err_D, LT_Pump_SH_D-gain, LT_Pump_SH_U, LT BO Temp_Err, LT_BO_Err_I_MAX, LT_BO_Err_I_MIN, LT_Pump_BO_P-gain, LT_Pump_BO_I-gain, LT_BO_Err_I, T, LT_BO_Err_D, LT_Pump_BO_D-gain, LT_Pump_BO_U, LT_Pump_Total_U, Engine Speed, Accel Pedal Position, LT Exhaust Heat, LT Pump Speed_MAX, LT Pump Speed_MIN, LT Pump Speed_NOM, and LT_Pump_Speed_Raw for processing an LT_pump_speed_target, are linked to each other.

Here, the variables described in FIGS. 2A and 2B to FIGS. 5A, 5B and 5C are defined as imported variables of Table 1, calibration variables of Table 2A and B, internal variables of Table 3A and B, and output variables of Table 4, respectively.

TABLE 1

| |
|---|
| ♦ Imported Variables |
| Engine Speed: Engine Rotational Speed/RPM |
| Accel Pedal Position: Accelerator Pedal Position/% |
| HT_SH_Temp: Temperature of Working Fluid at HT Superheater Downstream/° C. |
| HT_BO_Temp: Temperature of Working Fluid at HT Boiler Downstream/° C. |
| HT Pressure: HT Loop Pressure at Downstream HT Pump/bar |
| HT_Cond_Temp: Temperature of Working Fluid at HT Condenser Downstream/° C. |
| LT_SH_Temp: LT Superheater Downstream Temperature of Working Fluid/° C. |
| LT_BO_Temp: LT Boiler Downstream Temperature of Working Fluid/° C. |
| LT Pressure: LT Loop Pressure at Downstream (final) LT Pump/bar |
| Engine Error State: Engine Error State (Especially for the sensor signals in this function) |
| Engine Water Temperature: Engine Water Temperature/° C. |
| HT Pump Speed_Feedback: Feedback Value of HT Pump Rotational Speed/RPM |
| LT Pump Speed_Feedback: Feedback Value of LT Pump Rotational Speed/RPM |
| HT_BO_EXH_UH_TEMP: Temperature of Exhaust Gas at HT Boiler Upstream/° C. |
| HT_BO_EXH_DH_TEMP: Temperature of Exhaust Gas at HT Boiler Downstream/° C. |
| Coolant_RD_US_TEMP: Temperature of Coolant at Radiator Upstream/° C. |
| Coolant_RD_DS_TEMP: Temperature of Coolant at Radiator Downstream/° C. |

TABLE 2A

| |
|---|
| ♦ Calibration Variables |
| HT_SH_Temp_Target: Target Value of HT_SH_Temp: 0~500/° C. |
| HT_BO_Temp_Target: Target Value of HT_BO_Temp: 0~500/° C. |
| HT_Sub Cool_Target: Target Value of Sub Cooling at Downstream HT Condenser: 0~100/° C. |
| LT_SH_Temp_Target: Target Value of LT_SH_Temp: 0~200/° C. |
| LT_BO_Temp_Target: Target Value of LT_BO_Temp: 0~200/° C. |
| HT_SH_Temp_Warm-Up: Threshold for Decision Warm-Up Condition of HT_SH_Temp: 0~500/° C. |
| LT_SH_Temp_Warm-Up: Threshold for Decision Warm-Up Condition of LT_SH_Temp: 0~200/° C. |
| HT_SH_Temp_U-Limit: Upper Limit of HT_SH_Temp for Safety: 0~500/° C. |
| LT_SH_Temp_U-Limit: Upper Limit of LT_SH_Temp for Safety: 0~200/° C. |
| Engine Coolant Temp_U-Limit:: Upper Limit of Engine Coolant for Safety: 0~200/° C. |
| HT Saturation Temp_CUR: HT Working Fluid Saturation Temperature Characteristic Curve: 0~500/° C. |
| LT Saturation Temp_CUR: LT Working Fluid Saturation Temperature Characteristic Curve: 0~200/° C. |
| HT Pump Speed Diff_MAX: Maximum Speed Difference between HT Pump Speed Target and Real Value: 0~1000/RPM |
| LT Pump Speed Diff_MAX: Maximum Speed Difference between LT Pump Speed Target and Real Value: 0~1000/RPM |
| HT BO Exh BP On_Max: Maximum Exhaust Gas Temperature Difference between HT Boiler Upstream and Downstream when Bypass Valve is On (Bypass Mode): 0~1000/° C. |
| HT BO Exh BP Off_Min: Minimum Exhaust Gas Temperature Difference between HT Boiler Upstream and Downstream when Bypass Valve is Off (Heat Exchange Mode): 0~1000/° C. |
| Coolant RD Diff_MIN: Minimum Temperature Difference between Radiator Coolant Upstream and Downstream: 0~200/° C. |

TABLE 2B

| |
|---|
| HT Pump Time On Delay: Time Delay for HT Pump Error Healing/sec |
| LT Pump Time On Delay: Time Delay for LT Pump Error Healing/sec |
| Exhaust Gas Bypass Valve Time On Delay: Time Delay for Exhaust Gas Bypass Valve Error Healing/sec |
| Coolant Bypass Valve Time On Delay: Time Delay for Coolant Bypass Valve Error Healing/sec |
| HT SH Err_I_MAX: Maximum Value of HT SH Err_I: 0~1000/° C. |
| HT SH Err_I_MIN: Maximum Value of HT SH Err_I: 0~1000/° C. |
| HT BO Err_I_MAX: Maximum Value of HT BO Err_I: 0~1000/° C. |
| HT BO Err_I_MIN: Maximum Value of HT BO Err_I: 0~1000/° C. |
| HT Exhaust Heat_MAP: Map of HT Loop Exhaust Heat Energy: 0~1000/kW |
| HT Pump Speed_MAX: Maximum Threshold for HT Pump Speed: 0~10,000/RPM |
| HT Pump Speed_MIN: Minimum Threshold for HT Pump Speed: 0~10,000/RPM |
| HT Pump Speed_NOM: Nominal Speed for HT Pump at Certain Exhaust Energy: 0~10,000/RPM |
| HT Cond Err_I_MAX: Maximum Value of HT Cond Err_I: 0~1000/° C. |
| HT Cond Err_I_MIN: Minimum Value of HT Cond Err_I: 0~1000/° C. |
| LT SH Err_I_MAX: Maximum Value of LT SH Err_I: 0~1000/° C. |
| LT SH Err_I_MIN: Maximum Value of LT SH Err_I: 0~1000/° C. |
| LT BO Err_I_MAX: Maximum Value of LT BO Err_I: 0~1000/° C. |
| LT BO Err_I_MIN: Maximum Value of LT BO Err_I: 0~1000/° C. |
| LT Exhaust Heat_MAP: Map of LT Loop Exhaust Heat Energy: 0~1000/kW |
| LT Pump Speed_MAX: Maximum Threshold for LT Pump Speed: 0~10,000/RPM |
| LT Pump Speed_MIN: Minimum Threshold for LT Pump Speed: 0~10,000/RPM |
| LT Pump Speed_NOM: Nominal Speed for LT Pump at Certain Exhaust Energy: 0~10,000/RPM |

TABLE 3A

| |
|---|
| ♦ Internal Variables |
| HT_SH_Temp_Err: Temperature Difference between HT_SH_Temp_Target and HT_SH_Temp/° C. |
| HT_BO_Temp_Err: Temperature Difference between HT_BO_Temp_Target and HT_BO_Temp/° C. |
| HT_COND_Temp_Err: Temperature Difference between HT_COND_Temp_Target and HT_COND_Temp/° C. |

TABLE 3A-continued

| |
|---|
| LT_SH_Temp_Err: Temperature Difference between LT_SH_Temp_Target and LT_SH_Temp/° C. |
| LT_BO_Temp_Err: Temperature Difference between LT_BO_Temp_Target and LT_BO_Temp/° C. |
| HT_Saturation Temp: HT Saturation Temperature at Current Pressure Condition from HT_Saturation Temp_Curve/° C. |
| LT_Saturation Temp: LT Saturation Temperature at Current Pressure Condition from LT_Saturation Temp_Curve/° C. |
| HT Pump Speed Diff: Speed Difference between HT Pump Speed Target and Real Value/RPM |
| LT Pump Speed Diff: Speed Difference between LT Pump Speed Target and Real Value/RPM |
| HT SH Err_I: Integral Value of HT SH Err/° C. sec |
| HT SH Err_D: Derivative Value of HT SH Err/° C./sec |
| HT BO Err_I: Integral Value of HT BO Err/° C. sec |
| HT BO Err_D: Derivative Value of HT BO Err/° C./sec |
| HT Exhaust Heat: HT Loop Exhaust Heat Energy/kW |

TABLE 3B

| |
|---|
| HT_Pump_SH_U: HT Pump Control Input for HT Superheater Temperature/— |
| HT_Pump_BO_U: HT Pump Control Input for HT Boiler Temperature/— |
| HT_Pump_Total_U: Total Sum of HT Pump Control Input/— |
| HT Pump Speed_Raw: Raw Value of HT Pump Speed Demand/RPM |
| HT Cond Err_I: Integral Value of HT Cond Err/° C. sec |
| HT Cond Err_D: Derivative Value of HT Cond Err/° C./sec |
| LT SH Err_I: Integral Value of LT SH Err/° C. sec |
| LT SH Err_D: Derivative Value of LT SH Err/° C./sec |
| LT BO Err_I: Integral Value of LT BO Err/° C. sec |
| LT BO Err_D: Derivative Value of LT BO Err/° C./sec |
| LT_Pump_HC_U: LT Pump Control Input for HT Condenser Temperature/— |
| LT_Pump_SH_U: LT Pump Control Input for LT Superheater Temperature/— |
| LT_Pump_BO_U: LT Pump Control Input for LT Boiler Temperature/— |
| LT_Pump_Total_U: Total Sum of HT Pump Control Input/— |
| LT Exhaust Heat: LT Loop Exhaust Heat Dissipated from Radiator/kW |
| LT Pump Speed_Raw: Raw Value of LT Pump Speed Demand/RPM |

TABLE 4

| |
|---|
| ♦ Output Variables |
| HT Bypass Valve: Control Signal for HT Bypass Valve/bit (on/off) |
| LT Bypass Valve: Control Signal for LT Bypass Valve/bit (on/off) |
| Exhaust Gas Bypass Valve: Control Signal for Exhaust Gas Bypass Valve/bit (on/off) |
| Radiator Bypass Valve: Control Signal for Radiator Bypass Valve/bit (on/off) |
| HT Pump Speed_Target: HT Pump Rotational Speed Demand/RPM |
| LT Pump Speed _Target: LT Pump Rotational Speed Demand/RPM |
| HT Pump Error State: Error State of HT Pump/bit (on/off) |
| LT Pump Error State: Error State of LT Pump/bit (on/off) |
| Exhaust Gas Bypass Valve Error State: Error State of Exhaust Gas Bypass Valve/byte (normal/error colse/error opne) |

Figure 9A:
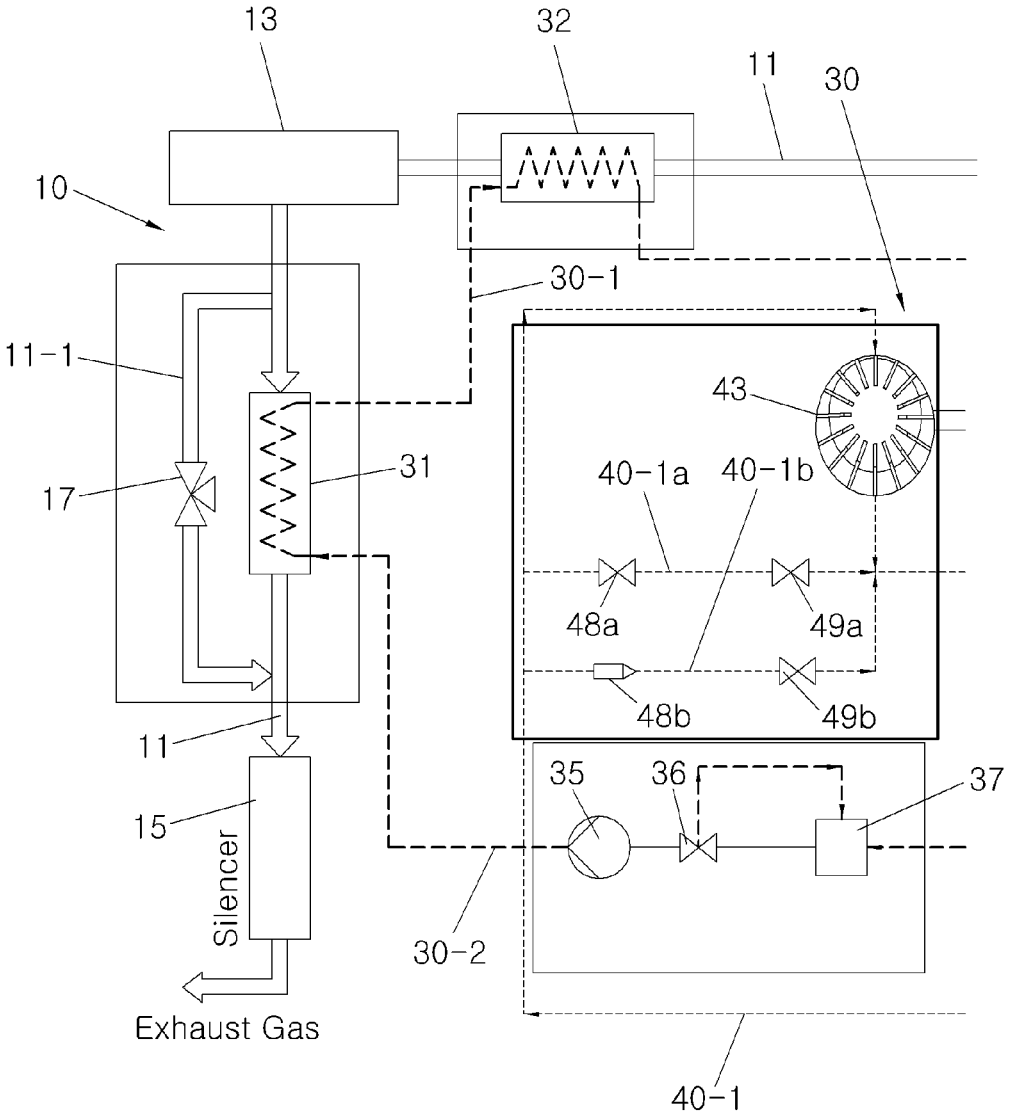
FIGS. 9A and 9B are a diagram illustration an operation state of a Rankine cycle system in the method of FIGS. 6A and 6B to FIGS. 8A, 8B and 8C.
Figure 9B:
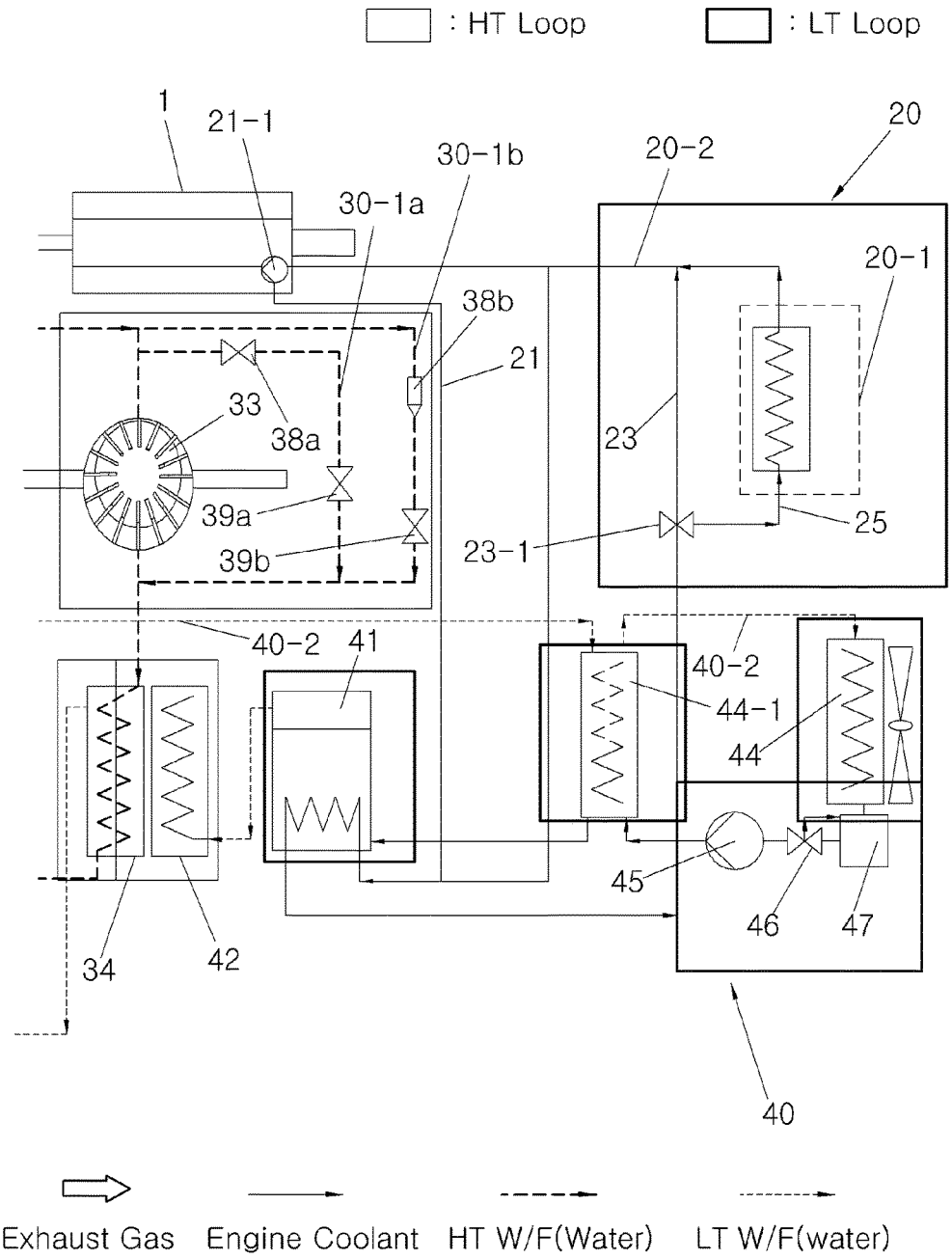

Meanwhile, FIGS. 6A and 6B to FIGS. 8A, 8B and 8C are flowcharts illustrating a method of controlling a Rankine cycle system for a vehicle having a dual fluid circulation circuit according to an embodiment of the present invention. In certain embodiments, such Rankine cycle system control is performed by the Rankine controller 100, and an operation of each component will be described with reference to FIGS. 1A and 1B. FIGS. 9A and 9B are a diagram illustration an operation state of a Rankine cycle system in the method of FIGS. 6A and 6B to FIGS. 8A, 8B and 8C. A symbol such as "=", "<", or ">" described below refers to a relation in which a size value of one element is equal to, smaller than, or greater than a size value of the other element.

Figure 6A:
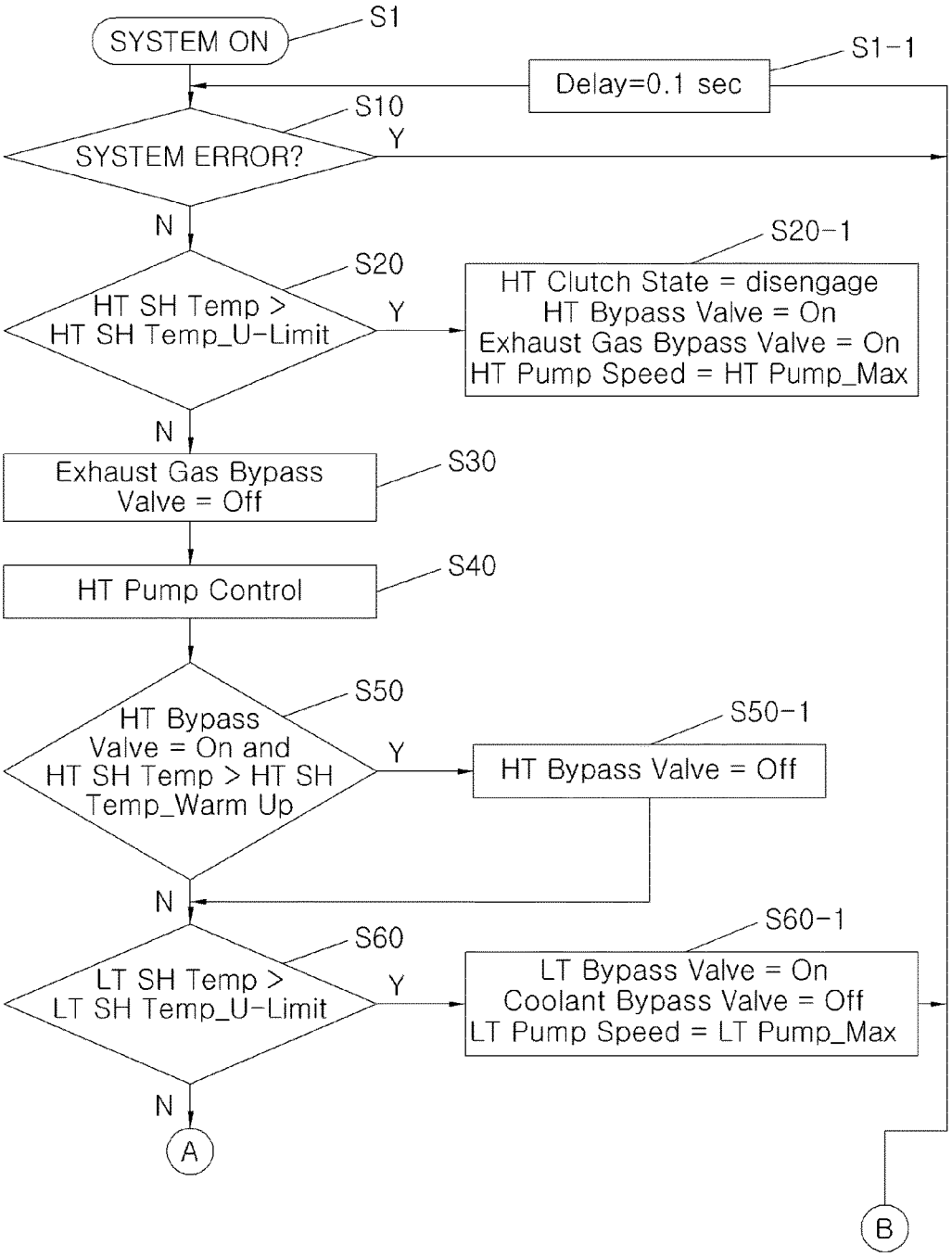
Figure 6B:
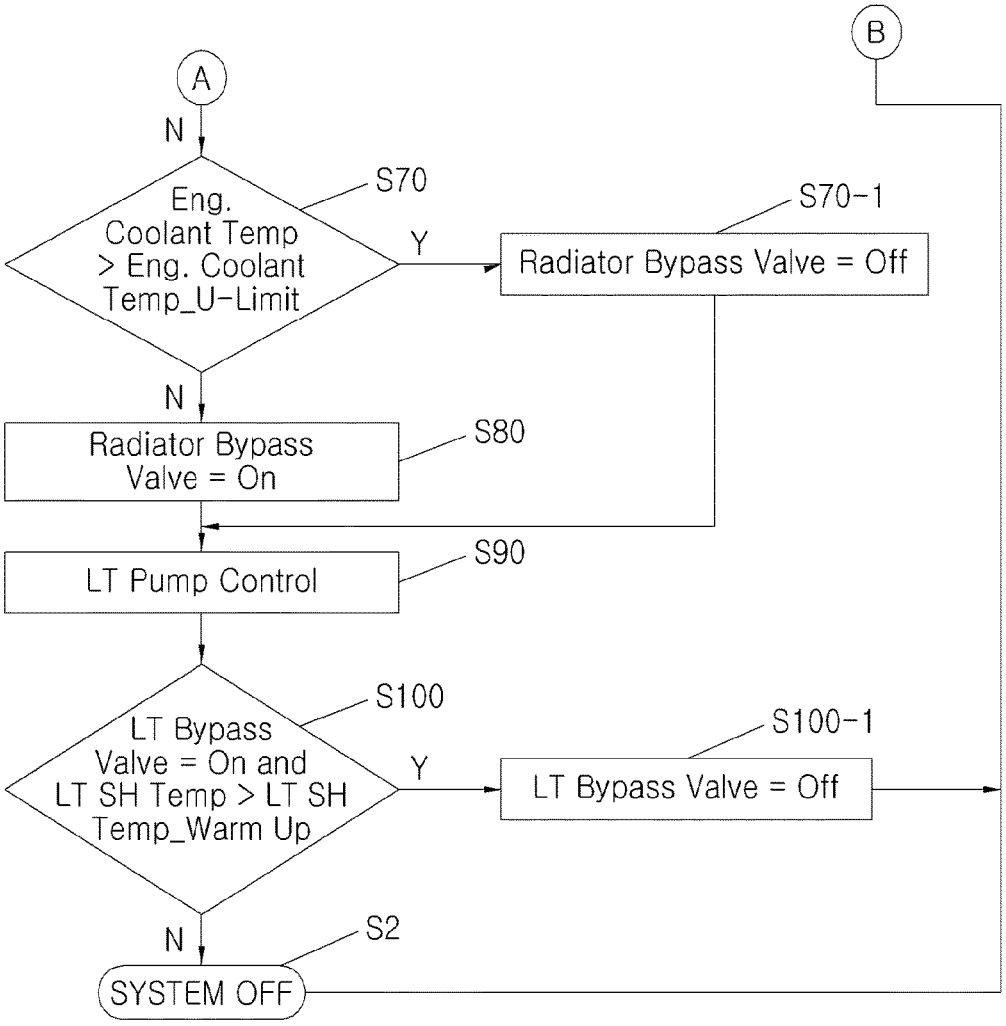
Figure 7A:
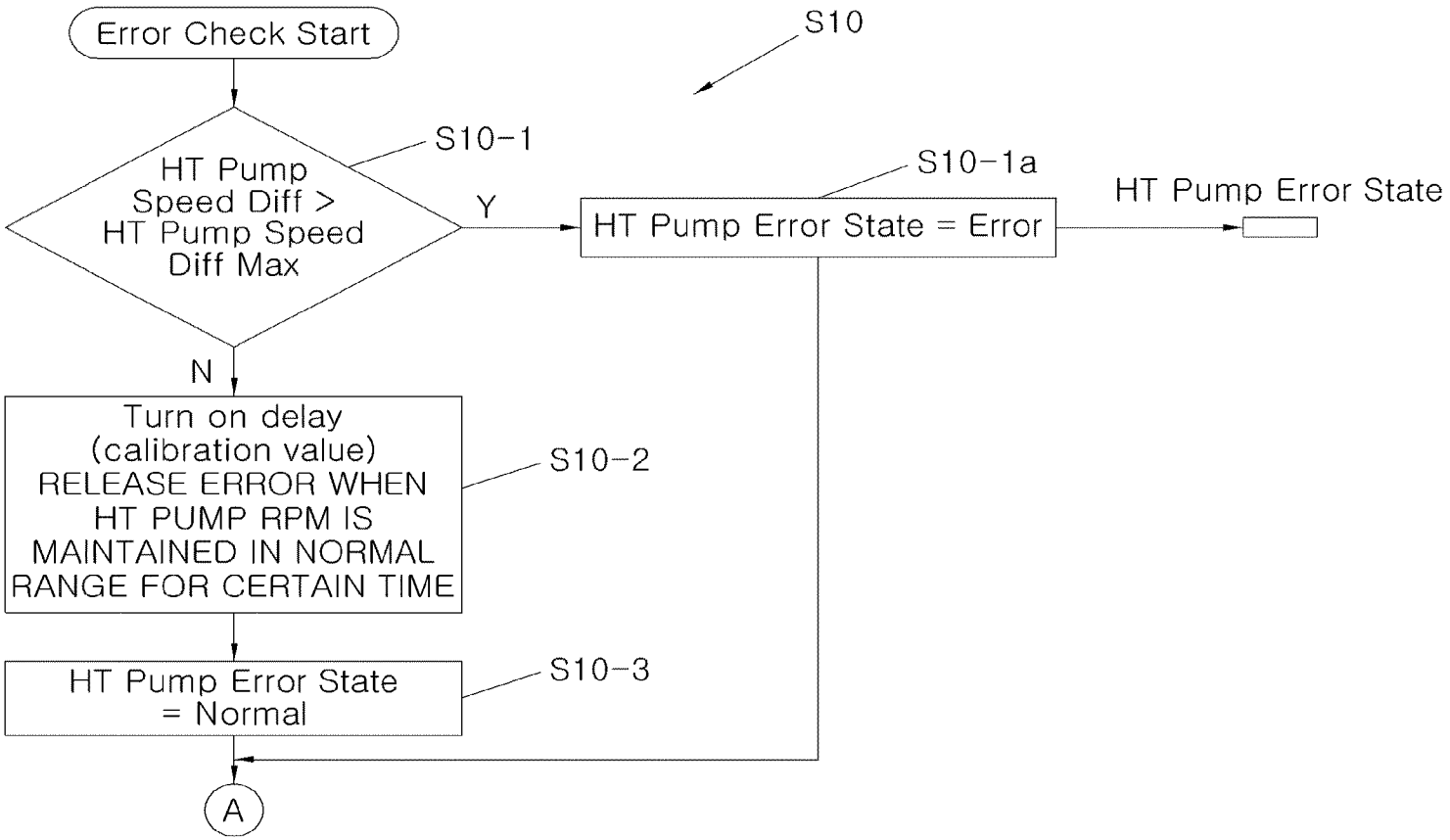
Figure 7B:
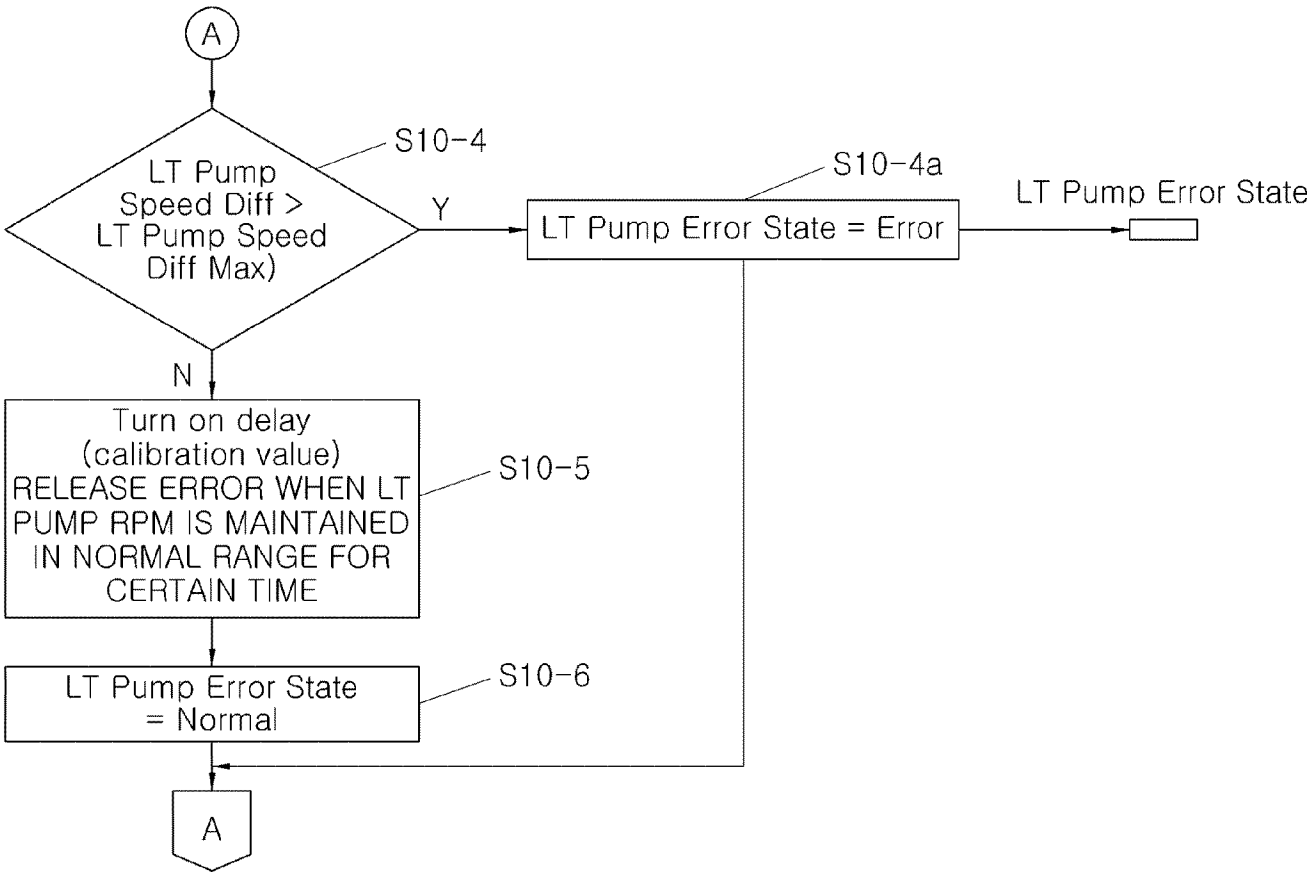
Figure 8A:
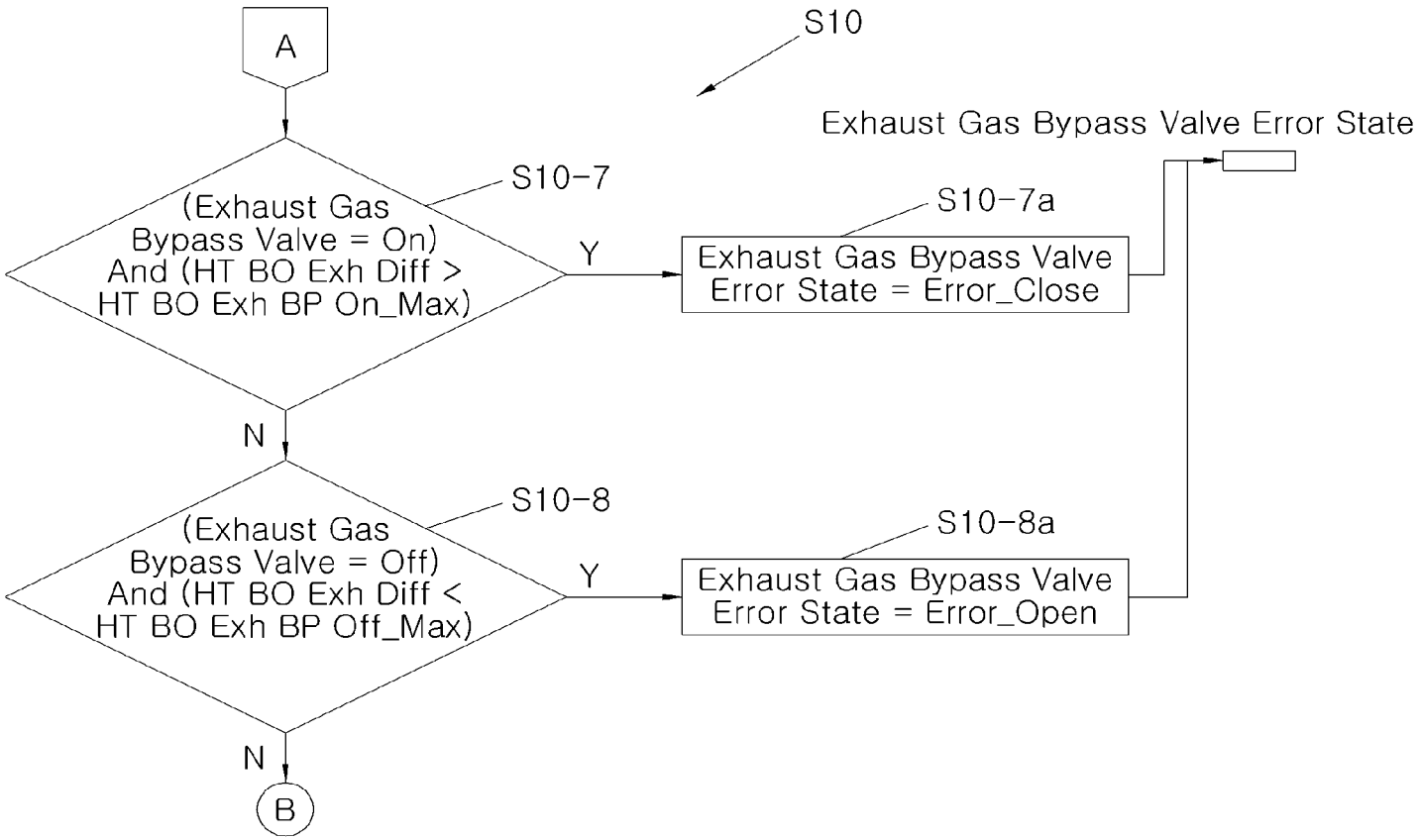
Figure 8B:
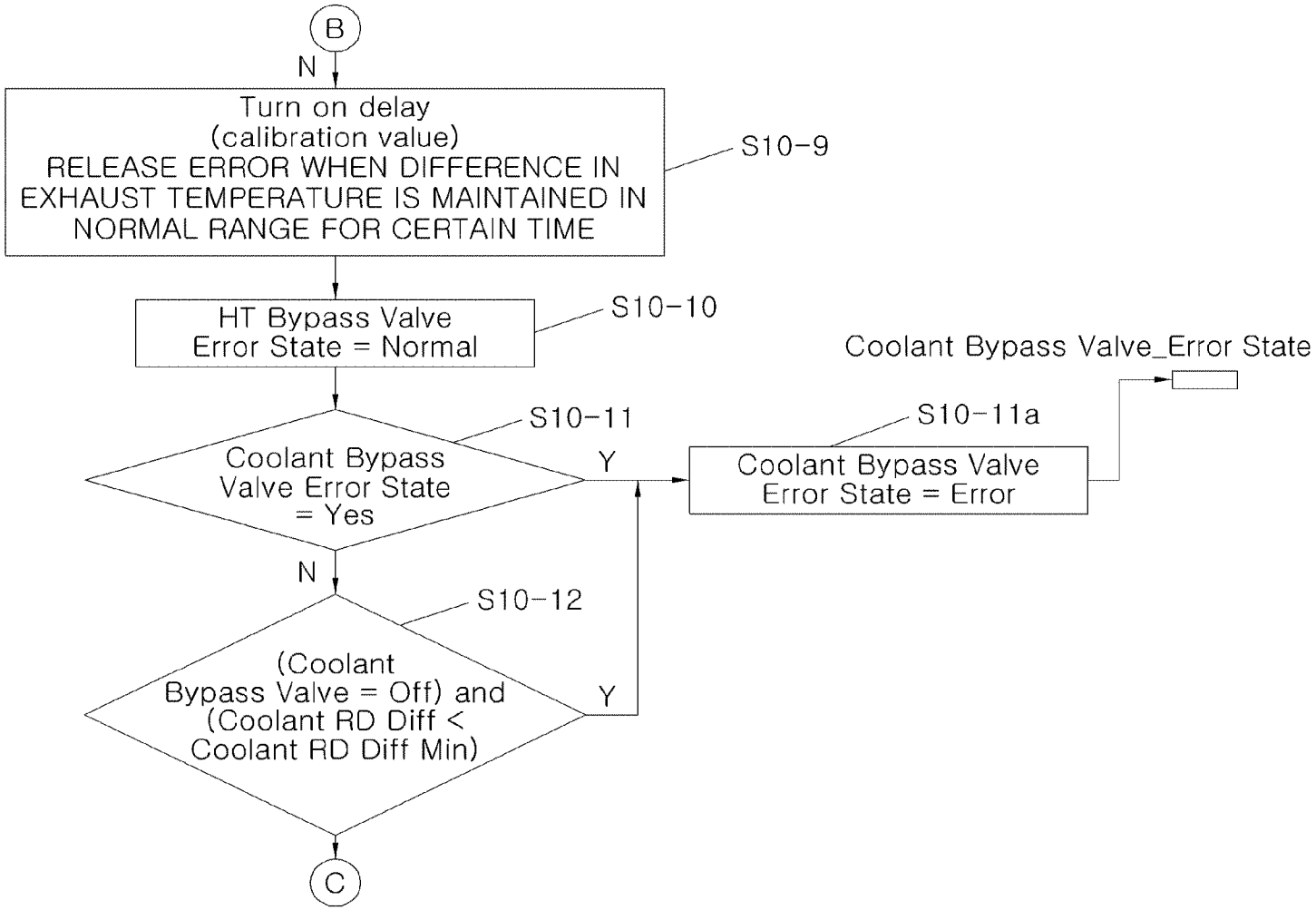
Figure 8C:
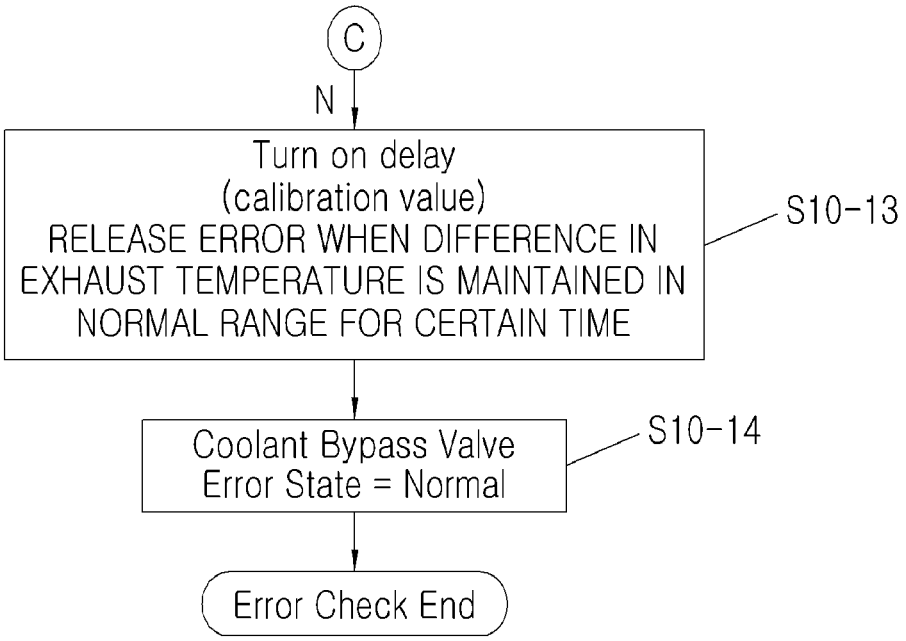

Referring to FIGS. 6A and 6B, in certain embodiments, when a Rankine cycle system is operated by starting an engine in step S1, an HT loop 30 and an LT loop 40 are initialized. In certain embodiments, through such system initialization, an HT clutch is disengaged, an HT bypass valve is turned on, an LT bypass valve is turned on, an exhaust bypass valve 17 is turned off, and a radiator bypass valve 23-1 is turned on. Here, the HT bypass valve is a valve which is installed on a high temperature fluid bypass line 30-1*a* branched from a high temperature fluid supply line 30-1 of the HT loop 30, and the LT bypass valve is a valve which is installed on a low temperature fluid bypass line 40-1*a* branched from a low temperature fluid supply line 40-1 of the LT loop 40.

After the system is operated in step S1, the process enters a system error check step S10. In certain embodiments, when an error is determined to be present in the system error check step S10, the process enters a step S1-1 after control of the system when the error is present in step S1 so that the system error check is repeated after a delay of, for example, 0.1 second. In certain embodiments, the system when the error is present is controlled such that the HT clutch is disengaged, the HT bypass valve is turned on, the LT bypass valve is turned on, the exhaust bypass valve 17 is turned off, the radiator bypass valve 23-1 is turned off, an HT pump 35 is controlled to be HT Pump Speed=HT Pump_Max, and an LT pump 45 is controlled to be LT Pump Speed=LT Pump_Max.

In certain embodiments, the error is determined to be not present in the system error check step S10, the process enters a step S20 to check a temperature of the HT loop 30. An HT SH Temp detected by an HT_SH 32 is applied in the HT loop temperature check step S20, and a condition of HT SH Temp>HT SH Temp_U-Limit is applied under the above step. When the condition of HT SH Temp>HT SH Temp_U-Limit is determined to be satisfied in the HT loop temperature check step S20, the HT loop is controlled. For example, the HT loop in step S20-1 is controlled such that the HT clutch is disengaged, the HT bypass valve is turned on, the exhaust bypass valve 17 is turned on, and the HT pump 35 is controlled to be HT Pump Speed=HT Pump_Max.

When the condition of HT SH Temp>HT SH Temp_U-Limit is determined to be not satisfied in the HT loop temperature check step S20, the process enters a step S30 so that the exhaust bypass valve 17 is turned off and instantly enters an HT loop control step S40 so as to use variables such as HT SH Temp, Engine Speed, Accel Pedal Position, HT SH Temp_Target, HT Pressure, HT Saturation Temp_CUR, and HT BO Temp.

Next, the process determines a bypass condition of a high temperature working fluid in the HT loop 30 in step S50. To this end, in the high temperature working fluid bypass condition, conditions such as HT Bypass Valve=On and HT SH Temp>HT SH Temp_Warm Up are applied, and variables such as HT SH Temp and HT SH Temp_Warm Up are used. When the conditions such as HT Bypass Valve=On and HT SH Temp>HT SH Temp_Warm Up are determined to be satisfied in step S50, the process enters a step S60 after HT Bypass Valve=Off in step S50-1.

Reference numeral S60 is a step of checking a temperature of a low temperature working fluid in the LT loop 40. The process enters the step S60 when the high temperature working fluid bypass condition is not satisfied in step S50 or after HT Bypass Valve=Off in step S50-1 so as to determine a condition of LT SH Temp>LT SH Temp_U-Limit. To this end, in the above condition, a variable such as LT SH Temp is applied.

After the LT bypass valve is turned on, the exhaust bypass valve 17 is turned off, the radiator bypass valve 23-1 is turned off, an engine radiator bypass valve is turned off, and the LT pump is changed to be LT Pump Speed=LT Pump_Max in step S60-1 when the condition of LT SH Temp>LT SH Temp_U-Limit is determined to be satisfied in step S60, the process enters the step S1-1 so that the system error check is repeated after a delay of 0.2 seconds.

When the condition of LT SH Temp>LT SH Temp_U-Limit is determined to be not satisfied in step S60, an engine coolant temperature is used in step S70. To this end, a condition of Eng. Coolant Temp>Eng. Coolant Temp_U-Limit is applied in step S70.

When the condition of Eng. Coolant Temp>Eng. Coolant Temp_U-Limit is determined to be satisfied in step S70, the radiator bypass valve 23-1 is turned off in step S70-1 and the process enters an LT loop control step S90. On the other hand, when the condition of Eng. Coolant Temp>Eng. Coolant Temp_U-Limit is determined to be not satisfied in step S70, the radiator bypass valve 23-1 is turned on in step S80 and the process enters the LT loop control step S90.

In the LT loop control step S90, variables such as Engine Speed, LT SH Temp, Engine coolant temperature, HT Pressure, HT Sub Cool Target, HT Cond Temp_Target, HT Cond Temp, HT Cond Temp_Err, LT SH Temp_Target, LT SH Temp_Err, LT Pressure, LT Saturation Temp_CUR, LT BO Temp, and LT BO Temp_Err are used.

Next, the process determines a bypass condition of a low temperature working fluid in the LT loop 40 in step S100. To this end, in the low temperature working fluid bypass condition, conditions such as LT Bypass Valve=On and LT SH Temp>LT SH Temp_Warm Up are applied, and variables such as LT SH Temp and LT SH Temp_Warm Up are used.

When the conditions such as LT Bypass Valve=On and LT SH Temp>LT SH Temp_Warm Up are determined to be satisfied in step S100, the process enters the step S1-1 after LT Bypass Valve=Off in step S100-1 so that the system error check is repeated after a delay of 0.2 seconds. When the conditions such as LT Bypass Valve=On and LT SH Temp>LT SH Temp_Warm Up are determined to be not satisfied in step S100, the process enters a step S2. In this case, the process enters the step S1-1 when the system error is not present, so that the system error check is repeated after a delay of 0.2 seconds.

Referring to FIGS. 7A and 7B to FIGS. 8A, 8B and 8C, in certain embodiments, the system error check in step S10 is departmentalized into steps S10-1 to S10-14.

Reference numeral S10-1 is a step of checking an error of the HT pump 35. In step S10-1, a condition of HT Pump Speed Diff>HT Pump Speed Diff Max is applied, and variables such as HT Pump Error State, HT Pump Speed, HT Pump Speed_Feedback, HT Pump Speed_Diff Max, and HT Pump Speed_Diff are used.

In certain embodiments, when the condition of HT Pump Speed Diff>HT Pump Speed Diff Max is satisfied in step S10-1, it is determined to be HT Pump Error State=Error in step S10-1*a*. As a result, an HT pump error state is output. On the other hand, when the condition of HT Pump Speed Diff>HT Pump Speed Diff Max is not satisfied in step S10-1, the process enters a step S10-2 so that a turn on delay (calibration value) for monitoring an HT pump RPM is performed.

In certain embodiments, when the HT pump RPM is maintained in a normal range for a certain time in step S10-2, the process enters a step S10-3 after release of the error and it is determined to be HT Pump Error State=Normal.

Next, in certain embodiments, reference numeral S10-4 is a step of checking an error of the LT pump 45. In step S10-4, a condition of LT Pump Speed Diff>LT Pump Speed Diff Max is applied, and variables such as LT Pump Speed, LT Pump Speed_Feedback, LT Pump SpeedM_Diff Max, and LT Pump Speed_Diff are used.

In certain embodiments, when the condition of LT Pump Speed Diff>LT Pump Speed Diff Max is satisfied in step S10-4, it is determined to be LT Pump Error State=Error in step S10-4*a*. As a result, an LT pump error state is output. On the other hand, when the condition of LT Pump Speed Diff>LT Pump Speed Diff Max is not satisfied in step S10-4, the process enters a step S10-5 so that a turn on delay (calibration value) for monitoring an LT pump RPM is performed.

When the LT pump RPM is maintained in a normal range for a certain time in step S10-5, the process enters a step S10-6 after release of the error and it is determined to be LT Pump Error State=Normal.

Next, in certain embodiments, reference numeral S10-7 is a step of checking an error of the exhaust gas bypass valve 17. In step S10-7, conditions of Exhaust Gas Bypass Valve=On and HT BO Exh Diff>HT BO Exh BP On_Max are applied, and variables such as Exhaust Gas Bypass Valve and HT BO Exh On Max are used. When the conditions of Exhaust Gas Bypass Valve=On and HT BO Exh Diff>HT BO Exh BP On_Max are satisfied in step S10-7, it is determined to be Exhaust Gas Bypass Valve Error State=Error_Close in step S10-7*a*. As a result, an exhaust gas bypass valve error state is output. On the other hand, when the conditions of Exhaust Gas Bypass Valve=On and HT BO Exh Diff>HT BO Exh BP On_Max are not satisfied in step S10-7, the process enters a step S10-8.

In certain embodiments, reference numeral S10-8 is a step of checking a repeated error of the exhaust gas bypass valve 17. In step S10-8, conditions of Exhaust Gas Bypass Valve=Off and HT BO Exh Diff<HT BO Exh BP Off_Min are applied, and variables such as Exhaust Gas Bypass Valve, HT BO Exh US_Temp, HT BO Exh DS_Temp, HT BO Exh Diff, and HT BO Exh Off Min are used. When the conditions of Exhaust Gas Bypass Valve=Off and HT BO Exh Diff<HT BO Exh BP Off_Min are satisfied in step S10-8, it is determined to be Exhaust Gas Bypass Valve Error State=Error_Open in step S10-8*a*. As a result, an exhaust gas bypass valve error state is output. On the other hand, when the conditions of Exhaust Gas Bypass Valve=Off and HT BO Exh Diff<HT BO Exh BP Off_Min are not satisfied in step S10-8, the process enters a step S10-9.

In certain embodiments, when a difference in temperature of the exhaust gas is maintained in a normal range for a certain time in step S10-9, the process enters a step S10-10 after release of the error and it is determined to be HT Bypass Valve Error State=Normal.

Next, reference numeral S10-11 is a step of checking an error of the radiator bypass valve. In step S10-11, a condition of Radiator Bypass Valve Error State=Yes is applied, and a variable such as Radiator Bypass Valve Motor Error is used. When the condition of Radiator Bypass Valve Error State=Yes is satisfied in step S10-11, it is determined to be Radiator Bypass Valve Error State=Error in step S10-11*a*. As a result, a radiator bypass valve_error state is output. On the other hand, when the condition of Radiator Bypass Valve Error State=Yes is not satisfied in step S10-11, the process enters a step S10-12.

In certain embodiments, reference numeral S10-12 is a step of checking a repeated error of the radiator bypass valve. In step S10-12, conditions of Radiator Bypass Valve=Off and Coolant RD Diff<Coolant RD Diff Min are applied, and variables such as Radiator Bypass Valve, Coolant RD Diff Min, Coolant RD US_Temp, Coolant RD DS_Temp, and Coolant RD Diff are used. When the conditions of Radiator Bypass Valve=Off and Coolant RD Diff<Coolant RD Diff Min are satisfied in step S10-12, it is determined to be Radiator Bypass Valve Error State=Error in step S10-11*a*. As a result, a radiator bypass valve_error state is output. On the other hand, when the conditions of Coolant Bypass Valve=Off and Coolant RD Diff<Coolant RD Diff Min are not satisfied in step S10-12, the process enters a step S10-13.

In certain embodiments, when a difference in temperature of the coolant is maintained in a normal range for a certain time in step S10-13, the process enters a step S10-14 after release of the error and it is determined to be Radiator Bypass Valve Error State=Normal.

Meanwhile, FIGS. 10A and 10B illustrate a primary PID control logic of FIGS. 3A and 3B to FIGS. 5A, 5B and 5C, namely, an HT pump PID reinforcement control logic used by the Rankine controller 100 controlling the HT loop 30 and the LT loop 40, and illustrates an example in which temperatures of an HT_BO 31 and an HT_SH 32 are used as control variables.

As shown in the drawing, in certain embodiments, in the HT pump PID reinforcement control logic, temperatures of high temperature working fluids at a rear end of the HT_BO 31 and a rear end of the HT_SH 32 are used as control variables, thereby enabling a temperature decrease to be predicted. Particularly, in the HT pump PID reinforcement control logic, a phenomenon may be reinforced in which a temperature between the HT_BO 31 and the HT_SH 32 is first decreased when the temperature at the rear end of the HT_SH is decreased in a saturation state during control of the HT pump 35 and then the temperature at the rear end of the HT_SH is decreased.

In addition, the advantages of the HT pump PID reinforcement control logic are similarly exhibited in the LT loop 40 having an LT pump PID reinforcement control logic in which temperatures of low temperature working fluids at a rear end of an LT BO 41 and a rear end of an LT SH 42 are used as control variables.

Therefore, in the embodiment, the primary PID control logic of FIGS. 6A and 6B to FIGS. 8A, 8B and 8C are applied as a basic logic, and various PID reinforcement logics in which characteristics of the respective components of the HT loop 30 and the LT loop 40 are set as control variables may be realized.

As described above, the Rankine cycle system for a vehicle having a dual fluid circulation circuit according to the embodiment includes the HT loop 30 in which the high temperature working fluid changed into steam for generation of rotation power by heat of exhaust gas discharged from the engine 1 is circulated and the LT loop 40 in which the low temperature working fluid easily changed into steam for generation of rotation power by further heat of the high temperature working fluid in the HT loop 30 is circulated while the LT loop 40 is connected with circulation of the engine coolant of the engine cooling system 20. In the Rankine cycle system, the low temperature working fluid is heated using the engine coolant of the engine cooling system 20 supplied to the LT loop 40 by control of the Rankine controller 100 under a temperature condition in which water is frozen, thereby allowing stable performance to be maintained under the condition in which water is frozen as in a cold weather area.

In accordance with the exemplary embodiments of the present invention, a Rankine cycle system may stably operate high/low temperature expanders and have an improved operation efficiency by stable operations of the high/low temperature expanders, by controlling temperatures of working fluids at outlets of high/low temperature superheaters under a constant condition by control of a high temperature pump in which a temperature between a high temperature boiler and the high temperature superheater is used as a control variable and control of a low temperature pump in which the temperature of the low temperature superheater is used as a control variable.

In addition, it may be possible to secure operation reliability since an error check of the Rankine cycle system is first performed when the Rankine cycle system using water as a working fluid is operated.

While the present invention has been described with respect to the specific embodiments, it will be apparent to those skilled in the art that various changes and modifications may be made without departing from the spirit and scope of the invention as defined in the following claims.

What is claimed is:

1. A Rankine cycle system for a vehicle having a dual fluid circulation circuit, comprising:

an engine;

a High Temperature (HT) loop forming a flow in which a high temperature working fluid is converted from a liquid state to steam by heat of exhaust gas discharged from the engine so that power is generated, and the steam is condensed back into the liquid state of the high temperature working fluid;

a Low Temperature (LT) loop forming a flow in which a temperature of a low temperature working fluid converted from a liquid state to steam is increased so that power is generated while the low temperature working fluid cools the high temperature working fluid in the HT loop, and the steam is condensed back into the liquid state of the low temperature working fluid; and an engine coolant circulation auxiliary line forming a circulation flow in which engine coolant heats the low temperature working fluid and is then returned to the engine after the engine coolant circulated in the engine is supplied to the LT loop, wherein the HT loop includes a high temperature fluid supply line connected to a main exhaust line through which the exhaust gas flows so that the high temperature working fluid is converted from liquid to the steam in the high temperature fluid supply line, and a high temperature boiler and a high temperature superheater which are installed on the high temperature fluid supply line, and wherein the HT loop further includes a catalytic converter installed on the main exhaust line;

a silencer installed on the main exhaust line;

a branch exhaust line branching off from a first section of the main exhaust line, the branch exhaust line connecting the catalytic converter to the silencer; and an exhaust bypass valve installed on the branch exhaust line, and wherein the high temperature boiler is installed in the first section of the main exhaust line, and the high temperature superheater is installed in a second section of the main exhaust line, the second section connecting the engine to the catalytic converter.

2. The Rankine cycle system of claim 1, wherein:

the HT loop comprises:

a high temperature expander for generating rotation power using the steam discharged from the high temperature fluid supply line; and a high temperature fluid return line in which the steam passing through the high temperature expander is changed into the liquid to be supplied to the high temperature fluid supply line;

the LT loop comprises:

a low temperature fluid supply line connected to the engine coolant circulation auxiliary line through which the engine coolant flows so that the low temperature working fluid is converted from liquid to the steam in the low temperature fluid supply line;

a low temperature expander for generating rotation power using the steam discharged from the low temperature fluid supply line; and a low temperature fluid return line in which the steam passing through the low temperature expander is changed into the liquid to be supplied to the low temperature fluid supply line; and the engine coolant circulation auxiliary line comprises:

an engine coolant withdrawal line through which the engine coolant is discharged from the engine;

an engine coolant direct return line through which the engine coolant is directly returned to the engine; and an engine coolant indirect return line branched off from the engine coolant direct return line so as to form a path through which the engine coolant in the engine coolant withdrawal line is returned to the engine via an engine radiator.

3. The Rankine cycle system of claim 2, wherein electricity generated by the rotation power of at least one of the high and low temperature expanders is supplied to a vehicle battery or a vehicle electric device.

4. The Rankine cycle system of claim 2, wherein the engine coolant direct return line and the engine coolant indirect return line are provided with a radiator bypass valve.

5. The Rankine cycle system of claim 2, wherein:

the HT loop further comprises:

a high temperature condenser, a high temperature pump, a high temperature electronic expansion valve, and a high temperature fluid reservoir which are installed on the high temperature fluid return line;

the LT loop further comprises:

a low temperature boiler and a low temperature superheater which are installed on the low temperature fluid supply line, and a low temperature recuperator, a low temperature condenser, a low temperature pump, a low temperature electronic expansion valve, and a low temperature fluid reservoir which are installed on the low temperature fluid return line; and the high temperature condenser is connected to the low temperature fluid supply line and the low temperature recuperator is connected to the low temperature fluid supply line.

6. The Rankine cycle system of claim 2, wherein:

the HT loop further comprises a high temperature fluid bypass line and a high temperature fluid safety line which each branch off of the high temperature fluid supply line to be connected to the high temperature fluid return line without passing through the high temperature expander; and the high temperature fluid bypass line is provided with a first orifice and a first bypass valve and the high temperature fluid safety line is provided with a first safety valve and a second orifice.

7. The Rankine cycle system of claim 2, wherein:

the LT loop further comprises a low temperature fluid bypass line and a low temperature fluid safety line which are each branched from the low temperature fluid supply line to be connected to the low temperature fluid return line without passing through the low temperature expander; and the low temperature fluid bypass line is provided with a third orifice and a second bypass valve and the low temperature fluid safety line is provided with a second safety valve and fourth orifice.

8. The Rankine cycle system of claim 1, wherein the HT loop and the LT loop are controlled in a PID manner by a Rankine controller configured to output a PWM duty (Pulse Width Modulation duty), and the Rankine controller comprises an error check block configured to check errors of the HT loop, the engine, or the LT loop, a high pump control block configured to configure the HT loop so as to control a speed of a high temperature pump for circulating the high temperature working fluid, and a low pump control block configured to configure the LT loop so as to control a speed of a low temperature pump for circulating the low temperature working fluid.

9. The Rankine cycle system of claim 8, wherein the Rankine controller further comprises an HT pump PID reinforcement control logic in which temperatures of the high temperature working fluidin a high temperature boiler and a high temperature superheater configuring the HT loop are applied as control variables, and an LT pump PID reinforcement control logic in which temperatures of the low temperature working fluid in a low temperature boiler and a low temperature superheater configuring the LT loop are applied as control variables.

* * * * *